US010014100B2

(12) United States Patent
Nakamura et al.

(10) Patent No.: US 10,014,100 B2
(45) Date of Patent: Jul. 3, 2018

(54) COIL SUBSTRATE, METHOD OF MANUFACTURING COIL SUBSTRATE AND INDUCTOR

(71) Applicant: SHINKO ELECTRIC INDUSTRIES CO., LTD., Nagano (JP)

(72) Inventors: Atsushi Nakamura, Nagano (JP); Tsukasa Nakanishi, Nagano (JP); Yoichi Sasada, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 54 days.

(21) Appl. No.: 15/180,421

(22) Filed: Jun. 13, 2016

(65) Prior Publication Data

US 2016/0284458 A1 Sep. 29, 2016

Related U.S. Application Data

(62) Division of application No. 14/488,400, filed on Sep. 17, 2014, now Pat. No. 9,396,874.

(30) Foreign Application Priority Data

Oct. 11, 2013 (JP) ..... 2013-214129

(51) Int. Cl.
*H01F 5/00* (2006.01)
*H01F 17/00* (2006.01)
(Continued)

(52) U.S. Cl.
CPC ..... *H01F 17/0013* (2013.01); *H01F 5/00* (2013.01); *H01F 17/04* (2013.01); *H01F 27/2804* (2013.01); *H01F 27/323* (2013.01); *H01F 41/04* (2013.01); *H01F 41/041* (2013.01); *H01F 41/042* (2013.01); *H01F 41/043* (2013.01); *H01F 41/045* (2013.01); *H01F 2017/048* (2013.01); *H01F 2027/2809* (2013.01); *Y10T 29/4902* (2015.01); *Y10T 29/49069* (2015.01);
(Continued)

(58) Field of Classification Search
CPC ..... H01F 5/00; H01F 27/00–27/36
USPC ..... 336/65, 200, 206–208, 232
See application file for complete search history.

(56) References Cited

U.S. PATENT DOCUMENTS 5,922,514 A 7/1999 Person et al.
6,000,128 A 12/1999 Umeno et al.
(Continued)

FOREIGN PATENT DOCUMENTS

CN 103180919 6/2013
JP H2-54205 U 4/1990
(Continued)

OTHER PUBLICATIONS

Office Action dated Aug. 8, 2017 issued with respect to the basic Japanese Patent Application No. 2013-214129.
(Continued)

*Primary Examiner* — Tuyen Nguyen
(74) *Attorney, Agent, or Firm* — IPUSA, PLLC

(57) ABSTRACT

A coil substrate includes a stacked structure in which a plurality of structures are stacked, each of the structures including a first insulating layer and a wiring formed on the first insulating layer, which becomes a part of a spiral-shaped coil; and an insulating film that covers a surface of the stacked structure, the spiral-shaped coil being formed by connecting the wirings of the adjacent structures in series.

13 Claims, 22 Drawing Sheets

(51) Int. Cl.

| | |
|---|---|
| ***H01F 27/28*** | (2006.01) |
| ***H01F 27/32*** | (2006.01) |
| ***H01F 41/04*** | (2006.01) |
| ***H01F 17/04*** | (2006.01) |

(52) U.S. Cl.
CPC .... *Y10T 29/49071* (2015.01); *Y10T 29/49073* (2015.01); *Y10T 156/10* (2015.01)

(56) References Cited

U.S. PATENT DOCUMENTS

| | | | |
|---|---|---|---|
| 6,568,054 | B1 | 5/2003 | Kumagai et al. |
| 2009/0243781 | A1 | 10/2009 | Nomura et al. |
| 2013/0222101 | A1 | 8/2013 | Ito et al. |

FOREIGN PATENT DOCUMENTS

| | | |
|---|---|---|
| JP | H5-347232 | 12/1993 |
| JP | H6-231996 | 8/1994 |
| JP | H8-17653 | 1/1996 |
| JP | 2001-313212 | 11/2001 |
| JP | 2003-168610 | 6/2003 |
| JP | 2008-053368 | 3/2008 |

OTHER PUBLICATIONS

Office Action dated Jun. 5, 2017 issued with respect to the corresponding Chinese Patent Application No. 201410493906.1.
Office Action dated Mar. 6, 2018 issued with respect to the basic Japanese Patent Application No. 2013-214129.

COIL SUBSTRATE, METHOD OF MANUFACTURING COIL SUBSTRATE AND INDUCTOR

CROSS-REFERENCE TO RELATED APPLICATION

This application is a divisional application of U.S. patent application Ser. No. 14/488,400 filed on Sep. 17, 2014, which claims the benefit of priority of Japanese Patent Application No. 2013-214129 filed on Oct. 11, 2013, where the entire contents of all of these applications are incorporated herein by reference.

BACKGROUND OF THE INVENTION

1. Field of the Invention

The present invention relates to a coil substrate, a method of manufacturing a coil substrate and an inductor including a coil substrate.

2. Description of the Related Art

Recently, the size of an electronic device such as a game device, a smartphone or the like has been becoming smaller and smaller. In accordance with this, it is required for various elements such as an inductor or the like that is mounted on the electronic device to be smaller. As such an inductor that is mounted on the electronic device, one that uses a wire winding coil is known, for example. An inductor using a wire winding coil is used as a power supply circuit or the like of an electronic device, for example (see Patent Document 1, for example).

However, as there is a limitation in reducing the width of the wire winding, the ratio of the area occupied by the wire winding with respect to the entire area of the inductor becomes large if the size of the inductor is to be made smaller. In such a case, it is difficult to form a closed magnetic circuit. Therefore, there is a limitation in downsizing the size of the inductor using the wire winding coil while maintaining sufficient inductance and it is considered that the size of the plan shape of such an inductor is about 1.6 mm×1.6 mm at minimum.

Patent Document

[Patent Document 1] Japanese Laid-open Patent Publication No. 2003-168610

SUMMARY OF THE INVENTION

The present invention is made in light of the above problems, and provides a smaller coil substrate or the like.

According to an embodiment, there is provided a coil substrate including a stacked structure in which a plurality of structures are stacked, each of the structures including a first insulating layer and a wiring formed on the first insulating layer, which becomes a part of a spiral-shaped coil; and an insulating film that covers a surface of the stacked structure, the spiral-shaped coil being formed by connecting the wirings of the adjacent structures in series.

Note that also arbitrary combinations of the above-described elements, and any changes of expressions in the present invention, made among methods, devices, systems and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1A:
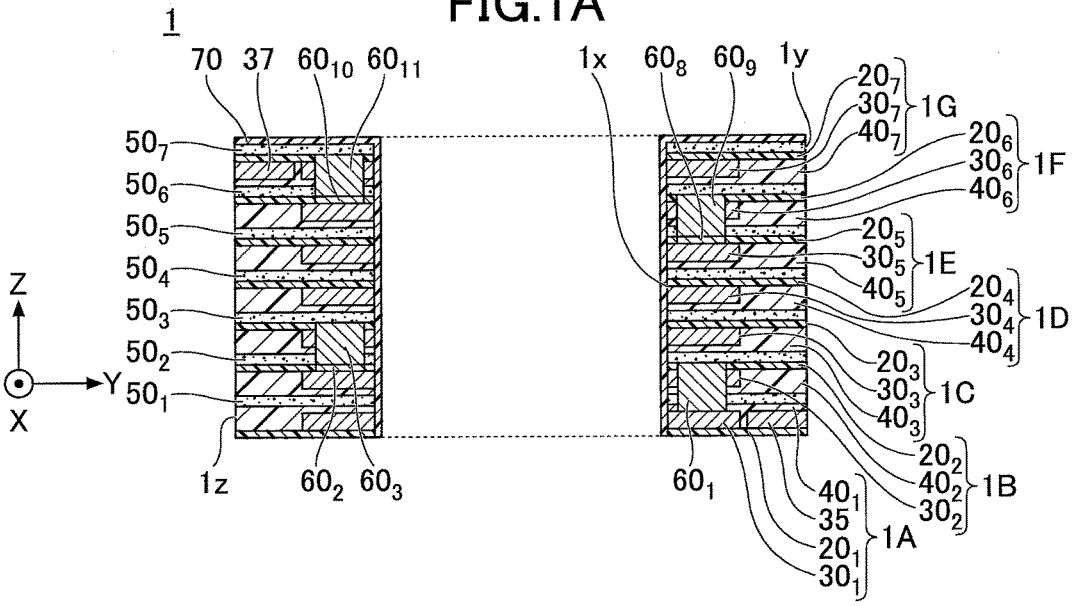
FIG. 1A to FIG. 1C are views illustrating an example of a coil substrate of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes. It is to be noted that, in the explanation of the drawings, the same components are given the same reference numerals, and explanations are not repeated.

(Structure of Coil Substrate)

Figure 1B:
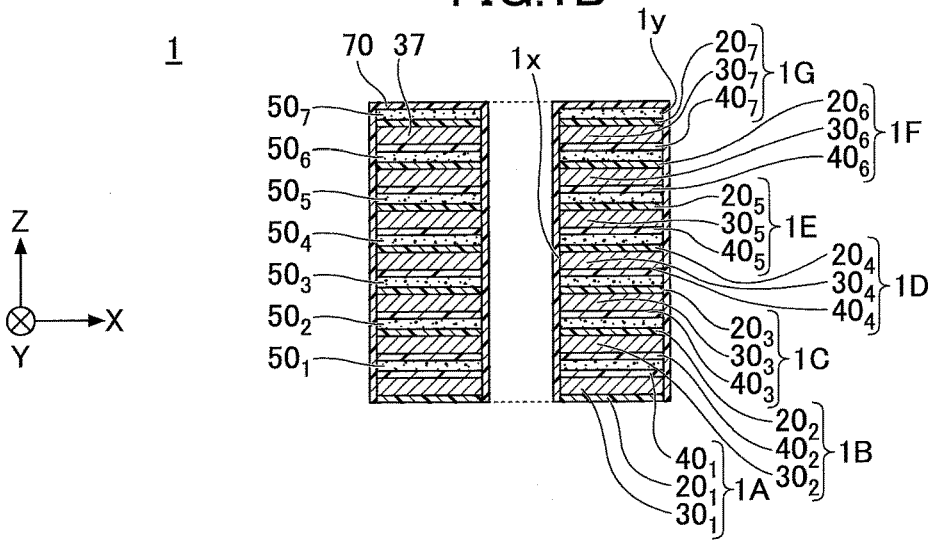
Figure 1C:
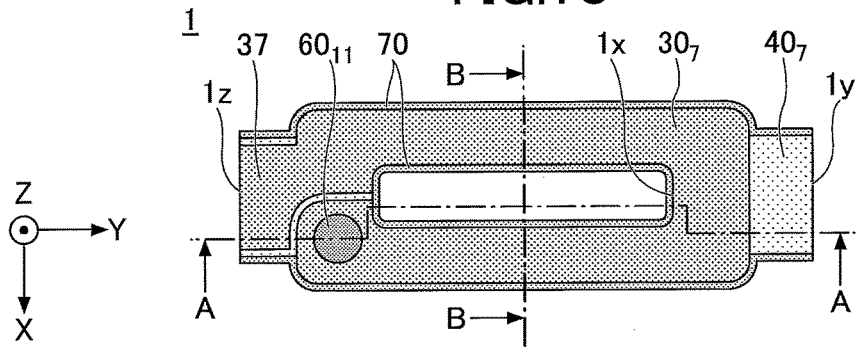
Figure 2:
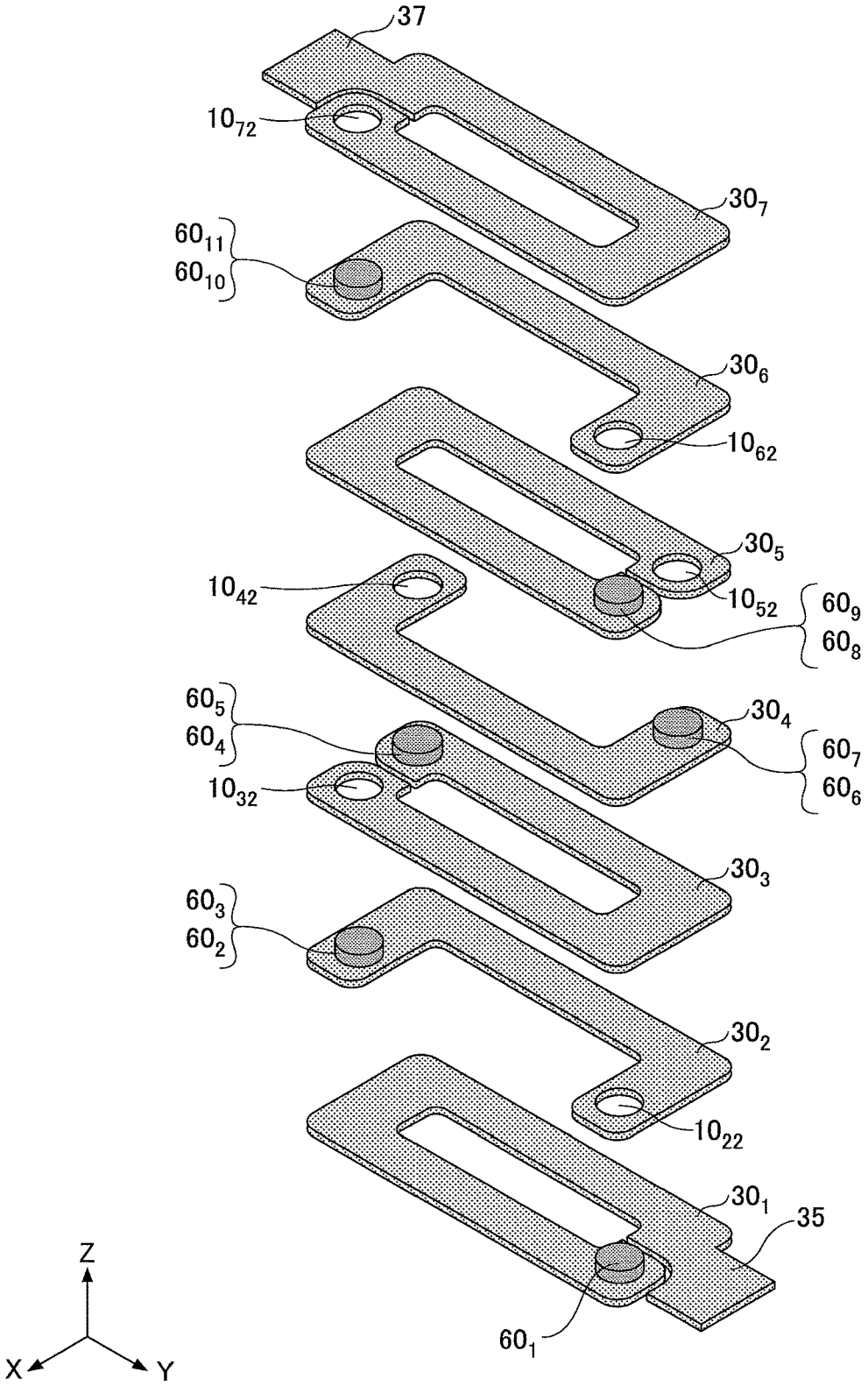
FIG. 2 is a perspective view schematically illustrating a shape of a wiring of each structure constituting the coil substrate of the embodiment.

The structure of a coil substrate of the embodiment is explained. FIG. 1A to FIG. 1C are views illustrating an example of a coil substrate 1 of the embodiment. FIG. 1C is a plan view, FIG. 1A is a cross-sectional view of FIG. 1C taken along an A-A line, and FIG. 1B is a cross-sectional view of FIG. 1C taken along a B-B line. FIG. 2 is a perspective view schematically illustrating a shape of a wiring of each structure constituting the coil substrate 1 of the embodiment.

With reference to FIG. 1A to FIG. 2, the coil substrate 1 mainly includes a first structure 1A, a second structure 1B, a third structure 1C, a fourth structure 1D, a fifth structure 1E, a sixth structure 1F, a seventh structure 1G, adhesion layers $\mathbf{50}_1$ to $\mathbf{50}_7$ and an insulating film 70. In FIG. 1C, the insulating layer $\mathbf{20}_7$, the adhesion layer $\mathbf{50}_7$ and the insulating film 70 formed on the adhesion layer $\mathbf{50}_7$ are not illustrated. In FIG. 1C, a portion is illustrated in a dot pattern for explanation purposes.

Further, in the following explanation, the drawings illustrating a method of manufacturing the coil substrate 1 are appropriately referred to. Further, in FIG. 1A to FIG. 1C, numerals of open portions are not illustrated, and numerals that are illustrated in the drawings illustrating the method of manufacturing the coil substrate 1 are referred to.

In this embodiment, an adhesion layer $\mathbf{50}_7$ side is referred to as an upper side or one side, and an insulating layer $\mathbf{20}_1$ side is referred to as a lower side or the other side. Further, a surface of each component at the adhesion layer $\mathbf{50}_7$ side is referred to as an upper surface or one surface, and a surface at the insulating layer $\mathbf{20}_1$ side is referred to as a lower surface or the other surface. However, the coil substrate 1 may be used in an opposite direction or may be used at an arbitrary angle. Further, in this embodiment, "in a plan view" means that an object is seen in a direction that is normal to one surface of the insulating layer $\mathbf{20}_1$, and a "plan shape" means a shape of an object seen in the direction that is normal to the one surface of the insulating layer $\mathbf{20}_1$.

As will be explained below, the coil substrate 1 is formed into an inductor 100 (see FIG. 3). Thus, the plan shape of the coil substrate 1 may have about a size such that the plan shape of the inductor 100 has substantially a rectangular shape of about 1.6 mm×0.8 mm, for example, when manufacturing the inductor 100 using the coil substrate 1. The thickness of the coil substrate 1 may be about 0.5 mm, for example.

The plan shape (outer edge) of the coil substrate 1 is not a simple rectangular shape but is similar to the plan shape of an outer edge of each wiring (a seventh wiring $\mathbf{30}_7$ or the like) that constitute the coil substrate 1. This is in order to form a large amount of sealing resin 110 around the coil substrate 1 when manufacturing the inductor 100 (see FIG. 3) using the coil substrate 1. Further, the coil substrate 1 is provided with a through hole 1*x* at the substantially center portion of the coil substrate 1. Similarly, this is in order to form a larger amount of the sealing resin 110 around the coil substrate 1 when manufacturing the inductor 100 (see FIG. 3) using the coil substrate 1. By using insulating resin (epoxy based insulating resin or the like, for example) including magnetic filler such as ferrite or the like as sealing resin 110, and sealing the large amount of the part around the coil substrate 1 including the inside of the through hole 1*x*, for example, the inductance of the inductor 100 can be made larger.

The first structure 1A includes an insulating layer $\mathbf{20}_1$, a first wiring $\mathbf{30}_1$, a connecting portion 35 and an insulating layer $\mathbf{40}_1$. The insulating layer $\mathbf{20}_1$ is formed as an outermost layer (undermost layer in FIG. 1A) of the coil substrate 1. For the material of the insulating layer $\mathbf{20}_1$, epoxy based insulating resin or the like may be used, for example. The thickness of the insulating layer $\mathbf{20}_1$ may be about 8 to 12 μm, for example.

The first wiring $\mathbf{30}_1$ and the connecting portion 35 are formed on the insulating layer $\mathbf{20}_1$. The material of the first wiring $\mathbf{30}_1$ and the connecting portion 35 may be copper (Cu), copper alloy or the like, for example. The thickness of the first wiring $\mathbf{30}_1$ and the connecting portion 35 may be about 12 to 50 μm, for example. The width of the first wiring $\mathbf{30}_1$ may be about 50 to 130 μm, for example. The first wiring $\mathbf{30}_1$ is a first layer wiring that is a part (about a roll) of a coil, and is patterned in substantially an elliptical shape in a direction illustrated in FIG. 2. Here, a direction along the coil (Y direction) is referred to as a longer direction and a width direction that is perpendicular to the longer direction is referred so as a shorter direction (X direction). The cross-sectional shape of the first wiring $\mathbf{30}_1$ in the shorter direction is substantially a rectangular shape.

The connecting portion 35 is formed at one end portion of the first wiring $\mathbf{30}_1$. A side surface of the connecting portion 35 is exposed from one side surface 1*y* of the coil substrate 1 and the exposed portion is connected to an electrode of the inductor 100. The connecting portion 35 is integrally formed with the first wiring $\mathbf{30}_1$.

The insulating layer $\mathbf{40}_1$ is formed on the insulating layer $\mathbf{20}_1$ such as to cover the first wiring $\mathbf{30}_1$ and the connecting portion 35. In other words, the first structure 1A includes the insulating layer $\mathbf{20}_1$, the first wiring $\mathbf{30}_1$ and the connecting portion 35 that are formed on the insulating layer $\mathbf{20}_1$ and become a part of the coil, and the insulating layer $\mathbf{40}_1$ formed on the insulating layer $\mathbf{20}_1$ such as to cover the first wiring $\mathbf{30}_1$ and the connecting portion 35. Here, one portion of the connecting portion 35 at the side surface is exposed from the insulating layer $\mathbf{40}_1$. The insulating layer $\mathbf{40}_1$ is provided with an open portion (open portion $\mathbf{40}_{11}$ in FIG. 5A) that exposes an upper surface of the first wiring $\mathbf{30}_1$, and a part of a via wiring $\mathbf{60}_1$ is filled in the open portion to be electrically connected with the first wiring $\mathbf{30}_1$. For the material of the insulating layer $\mathbf{40}_1$, photosensitive epoxy based insulating resin or the like may be used, for example. The thickness of the insulating layer $\mathbf{40}_1$ may be about 5 to 30 μm (the thickness from the upper surface of the first wiring $\mathbf{30}_1$), for example.

The second structure 1B is stacked on the first structure 1A through the adhesion layer $\mathbf{50}_1$. The second structure 1B includes an insulating layer $\mathbf{20}_2$, a second wiring $\mathbf{30}_2$ and an insulating layer $\mathbf{40}_2$. As the adhesion layer $\mathbf{50}_1$, a heat resistance adhesive made of insulating resin such as epoxy based adhesive, polyimide based adhesive or the like may be used, for example. The thickness of the adhesion layer $50_1$ may be about 10 to 40 μm, for example.

Here, in the following, the shape, the thickness, the material and the like of an insulating layer $20n$, an insulating layer $40n$ and an adhesion layer $50n$ (here, "n" is a natural number more than or equal to 2) are the same as those of the insulating layer $20_1$, insulating layer $40_1$ and the adhesion layer $50_1$ unless otherwise explained.

Further, the insulating layer $20n$ may be referred to as a first insulating layer and the insulating layer $40n$ may be referred to as a second insulating layer. Although the insulating layer $20n$ and the insulating layer $40n$ are added different numerals for explanation purposes, both function as insulating layers that cover the respective wiring. Thus, the insulating layer $20n$ and the insulating layer $40n$ in total may referred to as an insulating layer. Here, the coil substrate 1 may not include the insulating layer $40n$ when the wirings of the structures can be surely insulated from each other by the adhesion layer $50n$.

The insulating layer $40_2$ is stacked on the adhesion layer $50_1$. A bottom surface and a side surface of the second wiring $30_2$ are covered by the insulating layer $40_2$ and an upper surface of the second wiring $30_2$ is exposed from the insulating layer $40_2$. The material, the thickness and the like of the second wiring $30_2$ may be the same as those of the first wiring $30_1$. The second wiring $30_2$ is a second layer wiring that is a part (about ¾ roll) of the coil, and is patterned in substantially a semi-elliptical shape in the direction illustrated in FIG. 2. The cross-sectional shape of the second wiring $30_2$ in the shorter direction is substantially a rectangular shape.

The insulating layer $20_2$ is stacked on the second wiring $30_2$ and the insulating layer $40_2$. In other words, the second structure 1B has a vertically inversed structure of a structure including the insulating layer $20_2$, the second wiring $30_2$ that is formed on the insulating layer $20_2$ and is a part of the coil, and the insulating layer $40_2$ formed on the insulating layer $20_2$ such as to cover the second wiring $30_2$.

The second structure 1B is provided with an open portion that penetrates the insulating layer $20_2$, the second wiring $30_2$ and the insulating layer $40_2$ whose lower side is in communication with an open portion of the adhesion layer $50_1$ and the open portion of the insulating layer $40_1$. A via wiring $60_1$ is filled in these open portions (an open portion $10_{23}$ illustrated in FIG. 7A). The second wiring $30_2$ is electrically connected in series with the first wiring $30_1$ through the via wiring $60_1$. Further, the second structure 1B is provided with an open portion (an open portion $10_{21}$ illustrated in FIG. 7A) that penetrates the insulating layer $20_2$ and exposes an upper surface of the second wiring $30_2$, and a via wiring $60_2$ is filled in the open portion. The second wiring $30_2$ is electrically connected to the via wiring $60_2$.

The third structure 1C is stacked on the second structure 1B through the adhesion layer $50_2$. The third structure 1C includes an insulating layer $20_3$, a third wiring $30_3$ and an insulating layer $40_3$.

The insulating layer $40_3$ is stacked on the adhesion layer $50_2$. A bottom surface and a side surface of the third wiring $30_3$ are covered by the insulating layer $40_3$ and an upper surface of the third wiring $30_3$ is exposed from the insulating layer $40_3$. The material, the thickness and the like of the third wiring $30_3$ may be the same as those of the first wiring $30_1$. The third wiring $30_3$ is a third layer wiring that is a part (about a roll) of the coil, and is patterned in substantially a semi-elliptical shape in the direction illustrated in FIG. 2. The cross-sectional shape of the third wiring $30_3$ in the shorter direction is substantially a rectangular shape.

The insulating layer $20_3$ is stacked on the third wiring $30_3$ and the insulating layer $40_3$. In other words, the third structure 1C has a vertically inversed structure of a structure including the insulating layer $20_3$, the third wiring $30_3$ that is formed on the insulating layer $20_3$ and is a part of the coil, and the insulating layer $40_3$ formed on the insulating layer $20_3$ such as to cover the third wiring $30_3$.

The third structure 1C is provided with an open portion that penetrates the insulating layer $20_3$, the third wiring $30_3$ and the insulating layer $40_3$ whose lower side is in communication with an open portion of the adhesion layer $50_2$. The via wiring $60_3$ is filled in these open portions (an open portion $10_{33}$ in FIG. 9A). The via wiring $60_3$ is electrically connected to a via wiring $60_2$ that is filled in the open portion of the insulating layer $20_2$ of the second structure 1B. The third wiring $30_3$ is electrically connected in series with the second wiring $30_2$ through the via wirings $60_2$ and $60_3$. Further, the third structure 1C is provided with an open portion (an open portion $10_{31}$ in FIG. 85) that penetrates the insulating layer $20_3$ and exposes an upper surface of the third wiring $30_3$. A via wiring $60_4$ is filled in the open portion. The third wiring $30_3$ is electrically connected to the via wiring $60_4$.

The fourth structure 1D is stacked on the third structure 1C through the adhesion layer $50_3$. The fourth structure 1D includes an insulating layer $20_4$, a fourth wiring $30_4$ and an insulating layer $40_4$.

The insulating layer $40_4$ is stacked on the adhesion layer $50_3$. A bottom surface and a side surface of the fourth wiring $30_4$ are covered by the insulating layer $40_4$ and an upper surface is exposed from the insulating layer $40_4$. The material, the thickness and the like of the fourth wiring $30_4$ are the same as those of the first wiring $30_1$. The fourth wiring $30_4$ is a fourth layer wiring that is a part (about ¾ roll) of the coil, and is patterned in substantially a semi-elliptical shape in the direction illustrated in FIG. 2.

The insulating layer $20_4$ is stacked on the fourth wiring $30_4$ and the insulating layer $40_4$. In other words, the fourth structure 1D has a vertically inversed structure of a structure including the insulating layer $20_4$, the fourth wiring $30_4$ that is formed on the insulating layer $20_4$ and is a part of the coil, and the insulating layer $40_4$ formed on the insulating layer $20_4$ such as to cover the fourth wiring $30_4$.

The fourth structure 1D is provided with an open portion that penetrates the insulating layer $20_4$, the fourth wiring $30_4$ and the insulating layer $40_4$ whose lower side is in communication with an open portion of the adhesion layer $50_3$. The via wiring $60_5$ is filled in these open portions. The via wiring $60_5$ is electrically connected to the via wiring $60_4$ formed in the open portion of the insulating layer $20_3$ of the third structure 1C. The fourth wiring $30_4$ is electrically connected in series with the third wiring $30_3$ through the via wirings $60_4$ and $60_5$. Further, the fourth structure 1D is provided with an open portion that penetrates the insulating layer $20_4$ and exposes an upper surface of the fourth wiring $30_4$. A via wiring $60_6$ is filled in the open portion. The fourth wiring $30_4$ is electrically connected to the via wiring $60_6$.

The fourth structure 1D has the same structure as the second structure 1B and corresponds to a structure obtained by rotating the second structure 1B 180° around an axis of normal of an X-Y plane. The open portions $10_{41}$ and $10_{42}$ respectively correspond to the open portions $10_{21}$ and $10_{22}$.

The fifth structure 1E is stacked on the fourth structure 1D through the adhesion layer $50_4$. The fifth structure 1E includes an insulating layer $20_5$, a fifth wiring $30_5$ and an insulating layer $40_5$.

The insulating layer $40_5$ is stacked on the adhesion layer $50_4$. A bottom surface and a side surface of the fifth wiring $30_5$ are covered by the insulating layer $40_5$ and an upper surface of the fifth wiring $30_5$ is exposed from the insulating layer $40_5$. The material, the thickness and the like of the fifth wiring $30_5$ may be the same as those of the first wiring $30_1$. The fifth wiring $30_5$ is a fifth layer wiring that is a part (about a roll) of the coil, and is patterned in substantially a semi-elliptical shape in the direction illustrated in FIG. 2. The cross-sectional shape of the fifth wiring $30_5$ in the shorter direction is substantially a rectangular shape.

The insulating layer $20_5$ is stacked on the fifth wiring $30_5$ and the insulating layer $40_5$. In other words, the fifth structure 1E has a vertically inversed structure of a structure including the insulating layer $20_5$, the fifth wiring $30_5$ that is formed on the insulating layer $20_5$ and is a part of the coil, and the insulating layer $40_5$ formed on the insulating layer $20_5$ such as to cover the fifth wiring $30_5$.

The fifth structure 1E is provided with an open portion that penetrates the insulating layer $20_5$, the fifth wiring $30_5$ and the insulating layer $40_5$ whose lower side is in communication with an open portion of the adhesion layer $50_4$. The via wiring $60_7$ is filled in the open portion (an open portion $10_{53}$ illustrated in FIG. 13A and FIG. 13B). The via wiring $60_7$ is electrically connected to a via wiring $60_6$ that is filled in the open portion of the insulating layer $20_4$ of the fourth structure 1D. The fifth wiring $30_5$ is electrically connected in series with the fourth wiring $30_4$ through the via wirings $60_6$ and $60_7$. The fifth structure 1E is provided with an open portion (an open portion $10_{51}$ illustrated in FIG. 123) that penetrates the insulating layer $20_5$ and exposes an upper surface of the fifth wiring $30_5$. A via wiring $60_8$ is filled in the open portion. The fifth wiring $30_5$ is electrically connected to the via wiring $60_8$.

The fifth structure 1E has the same structure as the third structure 1C and corresponds to a structure obtained by rotating the third structure 1C 180° around the normal axis of the X-Y plane. The open portions $10_{51}$ and $10_{52}$ respectively correspond to the open portions $10_{31}$ and $10_{32}$.

The sixth structure 1F is stacked on the fifth structure 1E through the adhesion layer $50_5$. The sixth structure 1F includes an insulating layer $20_6$, a sixth wiring $30_6$ and an insulating layer $40_6$.

The insulating layer $40_6$ is stacked on the adhesion layer $50_5$. A bottom surface and a side surface of the sixth wiring $30_6$ are covered by the insulating layer $40_6$ and an upper surface of the sixth wiring $30_6$ is exposed from the insulating layer $40_6$. The material, the thickness and the like of the sixth wiring $30_6$ may be the same as those of the first wiring $30_1$. The sixth wiring $30_6$ is a sixth layer wiring that is a part (about ¾ roll) of the coil, and is patterned in substantially a semi-elliptical shape in the direction illustrated in FIG. 2. The cross-sectional shape of the sixth wiring $30_6$ in the shorter direction is substantially a rectangular shape.

The insulating layer $20_6$ is stacked on the sixth wiring $30_6$ and the insulating layer $40_6$. In other words, the sixth structure 1F has a vertically inversed structure of a structure including the insulating layer $20_6$, the sixth wiring $30_6$ that is formed on the insulating layer $20_6$ and is a part of the coil, and the insulating layer $40_6$ formed on the insulating layer $20_6$ such as to cover the sixth wiring $30_6$.

The sixth structure 1F is provided with an open portion that penetrates the insulating layer $20_6$, the sixth wiring $30_6$ and the insulating layer $40_6$ whose lower side is in communication with an open portion of the adhesion layer $50_5$. The via wiring $60_9$ is filled in the open portion (an open portion $10_{63}$ illustrated in FIG. 14A and FIG. 14B). The via wiring $60_9$ is electrically connected to a via wiring $60_8$ formed in the open portion of the insulating layer $20_5$ of the fifth structure 1E. The sixth wiring $30_6$ is electrically connected in series with the fifth wiring $30_5$ through the via wirings $60_8$ and $60_9$. The sixth structure 1F is provided with an open portion (open portion $10_{61}$ illustrated in FIG. 14A) that penetrates the insulating layer $20_6$ and exposes an upper surface of the sixth wiring $30_6$. A via wiring $60_{10}$ is filled in the open portion. The sixth wiring $30_6$ is electrically connected to the via wiring $60_{10}$.

Although the reference numerals are different in the sixth structure 1F and the second structure 1B, the sixth structure 1F has the same structure as the second structure 1B and the open portions $10_{61}$ and $10_{62}$ respectively correspond to the open portions $10_{21}$ and $10_{22}$.

The seventh structure 1G is stacked on the sixth structure 1F through the adhesion layer $50_6$. The seventh structure 1G includes an insulating layer $20_7$, a seventh wiring $30_7$, a connecting portion 37 and an insulating layer $40_7$.

The insulating layer $40_7$ is stacked on the adhesion layer $50_6$. A bottom surface and a side surface of each of the seventh wiring $30_7$ and the connecting portion 37 are covered by the insulating layer $40_7$ and an upper surface of each of the seventh wiring $30_7$ and the connecting portion 37 is exposed from the insulating layer $40_7$. The material, the thickness and the like of the seventh wiring $30_7$ and the connecting portion 37 are the same as those of the first wiring $30_1$. The seventh wiring $30_7$ is an uppermost wiring layer, and is patterned in substantially a semi-elliptical shape in the direction illustrated in FIG. 2.

The connecting portion 37 is formed at one end portion of the seventh wiring $30_7$. A side surface of the connecting portion 37 is exposed from another side surface 1*z* of the coil substrate 1 and the exposed portion is connected to an electrode of the inductor 100. The connecting portion 37 is integrally formed with the seventh wiring $30_7$. The insulating layer $20_7$ is stacked on the seventh wiring $30_7$, the connecting portion 37 and the insulating layer $40_7$. In other words, the seventh structure 1G has a vertically inversed structure of a structure including the insulating layer $20_7$, the seventh wiring $30_7$ and the connecting portion 37 formed on the insulating layer $20_7$, and the insulating layer $40_7$ formed on the insulating layer $20_7$ such as to cover the seventh wiring $30_7$ and the connecting portion 37.

The seventh structure 1G is provided with an open portion that penetrates the insulating layer $20_7$, the seventh wiring $30_7$ and the insulating layer $40_7$ whose lower side is in communication with an open portion of the adhesion layer $50_6$. The via wiring $60_{11}$ is filled in these open portions (an open portion $10_{72}$ illustrated in FIG. 16A). The via wiring $60_{11}$ is electrically connected to a via wiring $60_{10}$ formed in the open portion of the insulating layer $20_6$ of the sixth structure 1F. The seventh wiring $30_7$ is electrically connected in series with the sixth wiring $30_6$ through the via wirings $60_{10}$ and $60_{11}$. As such, in the coil substrate 1, the spiral-shaped coil, from the connecting portion 35 to the connecting portion 37, is formed by connecting the wirings of the adjacent structures in series.

The adhesion layer $50_7$ is stacked on the seventh structure 1G. The adhesion layer $50_7$ is not provided with an open portion. This means that an upper side of the stacked structure in which the first structure 1A to the seventh structure 1G are stacked is covered by the adhesion layer $50_7$, which is an insulating layer, and any conductive materials are not exposed.

In the stacked structure in which the first structure 1A to the seventh structure 1G are stacked, surfaces except the bottom surface and the side surfaces 1$y$ and 1$z$ are covered by the insulating film 70. The inner wall surface of the through hole 1$x$ is also covered by the insulating film 70. The insulating film 70 is provided to prevent a short between the end surfaces of the wirings that are exposed from the stacked structure and conductive materials (magnetic filler or the like) that may be included in the sealing resin 110 when manufacturing the inductor 100 (see FIG. 3). For the insulating film 70, epoxy based insulating resin, acrylic based insulating resin or the like may be used, for example. The insulating film 70 may include filler such as silica or the like. The thickness of the insulating film 70 may be about 20 to 50 μm, for example.

Figure 3:
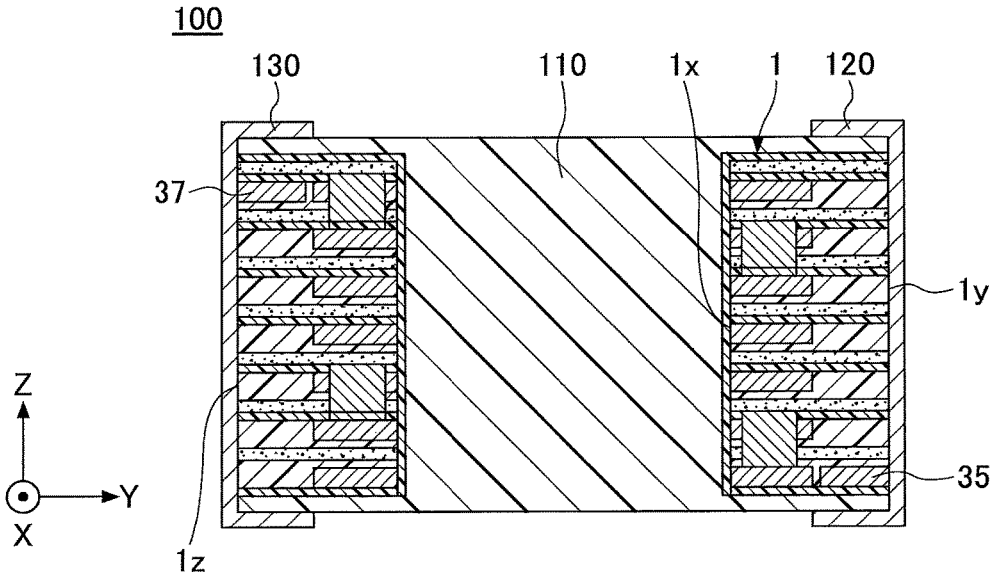
FIG. 3 is a cross-sectional view illustrating an example of an inductor of the embodiment.

FIG. 3 is a cross-sectional view illustrating an example of the inductor 1 of the embodiment. With reference to FIG. 3, the inductor 100 is a chip inductor in which the coil substrate 1 is sealed by the sealing resin 110 and electrodes 120 and 130 are formed. The plan shape of the inductor 100 may be substantially a rectangular shape having a size of about 1.6 mm×0.8 mm. The thickness of the inductor 100 may be about 1.0 mm, for example. The inductor 100 may be used as a voltage conversion circuit or the like of a small-size electronic device, for example.

In the inductor 100, the sealing resin 110 seals the coil substrate 1 except portions at the one side surface 1$y$ and the other side surface 1$z$. This means that the sealing resin 110 covers the coil substrate 1 except the portions of the side surfaces where the connecting portions 35 and 37 are exposed. The sealing resin 110 is also formed in the through hole 1$x$. For the sealing resin 110, insulating resin (epoxy based insulating resin or the like, for example) including magnetic filler such as ferrite or the like may be used, for example. The magnetic material has a function to increase the inductance of the inductor 100.

As such, according to the coil substrate 1, as the through hole 1$x$ is provided and the through hole 1$x$ is also filled with the insulating resin such as the epoxy based insulating resin or the like including the magnetic material, the inductance can be improved. Further, a core made of a magnetic material such as ferrite or the like may be provided in the through hole 1$x$ and the core may be also sealed by the sealing resin 110. The shape of the core may be a column shape, a rectangular parallelepiped shape or the like, for example.

The electrode 120 is formed outside the sealing resin 110 and is electrically connected to a part of the connecting portion 35. Specifically, the electrode 120 is continuously formed at the one side surface of the sealing resin 110 and parts of the upper surface and the lower surface of the sealing resin 110. An inner wall surface of the electrode 120 contacts a side surface of the connecting portion 35 that is exposed at the one side surface 1$y$ of the coil substrate 1 and the electrode 120 and the connecting portion 35 are electrically connected with each other.

The electrode 130 is formed outside the sealing resin 110 and is electrically connected to a part of the connecting portion 37. Specifically, the electrode 130 is continuously formed at the side surface of the sealing resin 110 and parts of the upper surface and the lower surface of the sealing resin 110. An inner wall surface of the electrode 130 contacts a side surface of the connecting portion 37 that is exposed at the other side surface 1$z$ of the coil substrate 1 and the electrode 130 and the connecting portion 37 are electrically connected with each other. For the material of the electrodes 120 and 130, copper (Cu), copper alloy or the like may be used, for example. The electrodes 120 and 130 may be formed by coating copper paste, sputtering of copper, electroless plating or the like, for example. The electrodes 120 and 130 may be a stacked structure of a plurality of metal layers.

(Method of Manufacturing Coil Substrate)

Figure 4A:
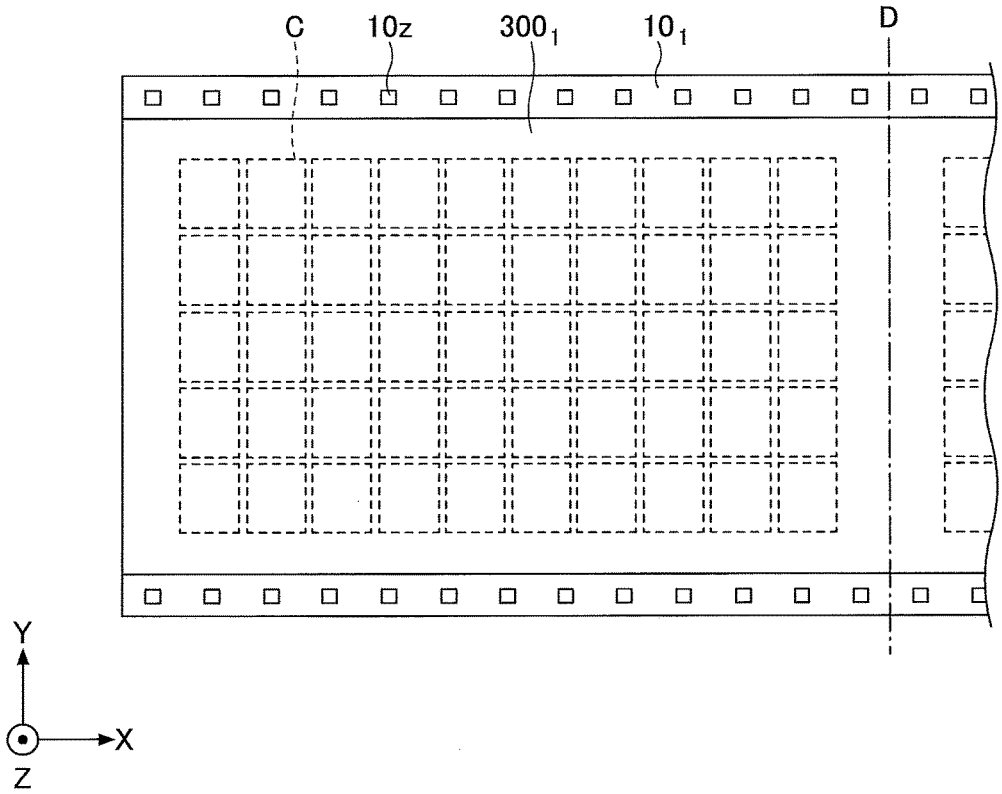
FIG. 4A and FIG. 4B are views illustrating an example of a manufacturing method of the coil substrate of the embodiment.
Figure 4B:
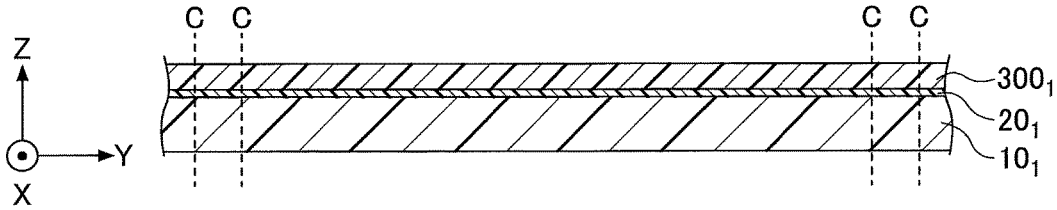

Next, a method of manufacturing the coil substrate of the embodiment is explained. FIG. 4A to FIG. 21C are views illustrating an example of the method of manufacturing the coil substrate of the embodiment. First, steps illustrated in FIG. 4A and FIG. 4B are explained. FIG. 4A is a plan view, and FIG. 4B is a cross-sectional view of FIG. 4A taken along a direction parallel to a Y-Z plane in FIG. 4A in the vicinity of one of individual areas C (which will be explained below). In the steps illustrated in FIG. 4A and FIG. 4B, first, a flexible reel (tape) insulating resin film is prepared as the substrate $\mathbf{10}_1$ (first substrate).

Then, sprocket holes 10$z$ are continuously formed at both end positions of the substrate $\mathbf{10}_1$ in a shorter direction (Y direction in FIG. 4A and FIG. 4B) along a longer direction (X direction in FIG. 4A and FIG. 4B) with substantially a same interval, by press working or the like. Thereafter, the insulating layer $\mathbf{20}_1$ and the metal film $\mathbf{300}_1$ are formed on one surface of the substrate $\mathbf{10}_1$ in this order at an area except the both end portions of the substrate $\mathbf{10}_1$ where the sprocket holes 10$z$ are formed. Specifically, the semi-cured insulating layer $\mathbf{20}_1$ and the metal film $\mathbf{300}_1$ are stacked on the one surface of the substrate $\mathbf{10}_1$ in this order and are heated so that the semi-cured insulating layer $\mathbf{20}_1$ is cured.

Each area C (referred to as the "individual areas C") expressed by a dashed line inside the both end portions of the substrate $\mathbf{10}_1$ where the sprocket holes 10$z$ are formed becomes the coil substrate 1 after finally being cut and individualized along the dashed lines. The plurality of individual areas C is aligned in columns and rows, for example. At this time, the plurality of individual areas C may be aligned with a predetermined space therebetween as illustrated in FIG. 4A, or may be aligned to contact with each other. Further, the number of individual areas C and the number of sprocket holes 10$z$ may be arbitrarily determined. Here, a line expressed by "D" (hereinafter, referred to as cut position D) indicates a cut position along which the reel (tape) substrate $\mathbf{10}_1$ or the like is cut in the following step.

For the substrate $\mathbf{10}_1$, polyphenylenesulfide film, polyimide film, polyethylenenaphthalate film or the like may be used, for example. The thickness of the substrate $\mathbf{10}_1$ may be about 50 to 75 μm, for example.

For the insulating layer $\mathbf{20}_1$, film epoxy based insulating resin or the like may be used, for example. Alternatively, for the insulating layer $\mathbf{20}_1$, liquid or paste epoxy based insulating resin or the like may be used. The thickness of the insulating layer $\mathbf{20}_1$ may be about 8 to 12 μm, for example. The metal film $\mathbf{300}_1$ becomes the metal layer $\mathbf{301}_1$ and the connecting portion 35 after being patterned, and may be made of a copper film, for example. The thickness of the metal film $\mathbf{300}_1$ may be about 12 to 50 μm, for example.

The sprocket holes 10$z$ are used for pitch feeding the substrate $\mathbf{10}_1$ by being engaged with pins of a sprocket that is driven by a motor or the like when the substrate $\mathbf{10}_1$ is mounted on a manufacturing apparatus or the like in the course of manufacturing the coil substrate 1. The width (in a direction perpendicular to the alignment direction of the sprocket holes 10$z$ (Y direction)) of the substrate $\mathbf{10}_1$ is determined to correspond to the manufacturing apparatus on which the substrate $\mathbf{10}_1$ is mounted.

The width of the substrate $\mathbf{10}_1$ may be about 40 to 90 mm, for example. On the other hand, the length of the substrate $\mathbf{10}_1$ (in an alignment direction of the sprocket holes 10$z$ (X direction)) may be arbitrarily determined. For the example illustrated in FIG. 4A, there are individual areas C of 5 rows and 10 columns. However, the substrate $\mathbf{10}_1$ may be made longer and the individual areas C of about few hundreds columns may be provided, for example.

Figure 5A:
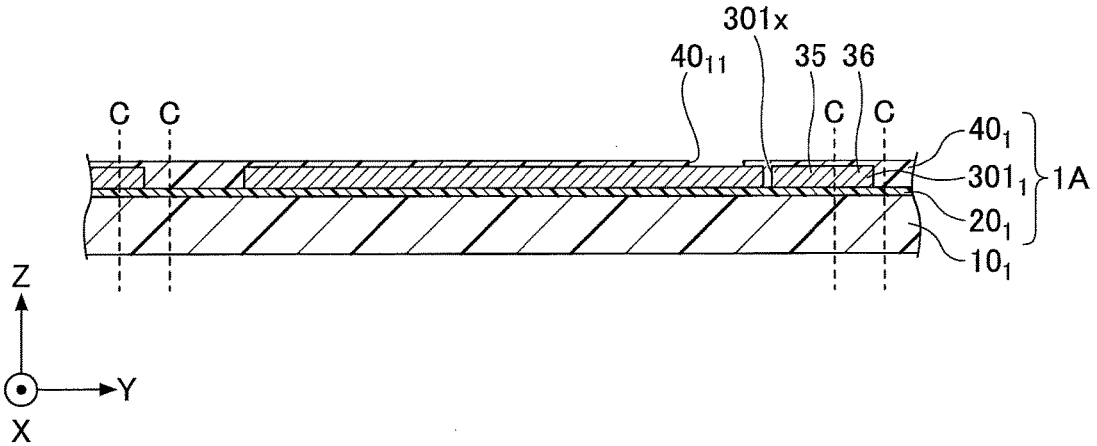
FIG. 5A and FIG. 5B are views illustrating an example of the manufacturing method of the coil substrate of the embodiment.
Figure 5B:
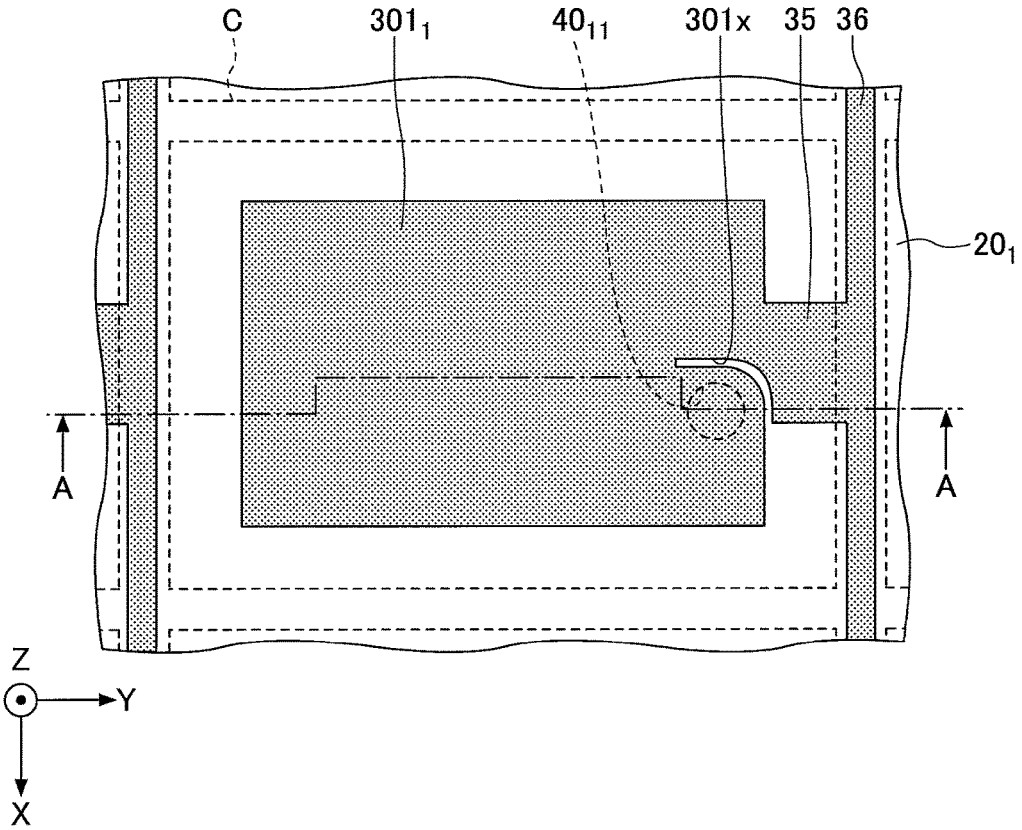

Next, in steps illustrated in FIG. 5A and FIG. 5B (FIG. 5B is a plan view and FIG. 5A is a cross-sectional view of FIG. 5B taken along an A-A line in FIG. 5B), the first structure 1A is formed in which metal layer $\mathbf{301}_1$ is formed on the substrate $\mathbf{10}_1$. The metal layer $\mathbf{301}_1$ becomes the first wiring $\mathbf{30}_1$ that is the first layer wiring and is a part (about a roll) of the coil after finally shaped (by die cutting or the like).

Specifically, the metal layer $\mathbf{301}_1$ is formed on the insulating layer $\mathbf{20}_1$ by patterning the metal film $\mathbf{300}_1$ illustrated in FIG. 4B. Further, at this time, the connecting portion 35 is formed at the one end portion of the metal layer $\mathbf{301}_1$. Further, at this time, a bus line 36 connected to the connecting portion 35 is formed. The bus line 36 is used for power supply in electroplating in the following steps and is electrically connected to the metal layer $\mathbf{301}_1$ and the connecting portion 35 of each of the individual areas C. If the electroplating is not performed in the following steps, the bus line 36 may not be formed. The metal layer $\mathbf{301}_1$ is provided with a slit portion 301*x*. The slit portion 301*x* is provided to facilitate forming a spiral shape of the coil when shaping (die cutting or the like) the coil substrate 1.

The metal film $\mathbf{300}_1$ may be patterned by photolithography, for example. This means that the metal film $\mathbf{300}_1$ may be patterned by forming photosensitive resist on the metal film $\mathbf{300}_1$, forming an open portion in the photosensitive resist by exposing and developing a predetermined area, and removing the metal film $\mathbf{300}_1$ that is exposed in the open portion by etching. The metal layer $\mathbf{301}_1$, the connecting portion 35 and the bus line 36 are integrally formed.

Thereafter, the metal layer $\mathbf{301}_1$, the connecting portion 35 and the bus line 36 are covered by the insulating layer $\mathbf{40}_1$. The insulating layer $\mathbf{40}_1$ may be formed by laminating a film photosensitive epoxy based insulating resin or the like. Alternatively, the insulating layer $\mathbf{40}_1$ may be formed by coating liquid or paste photosensitive epoxy based insulating resin or the like. The thickness of the insulating layer $\mathbf{40}_1$ (the thickness from the upper surface of the metal layer $\mathbf{301}_1$) may be about 5 to 30 μm, for example.

Thereafter, the open portion $\mathbf{40}_{11}$ is formed in the insulating layer $\mathbf{40}_1$ of the first structure 1A that exposes the upper surface of the metal layer $\mathbf{301}_1$. The plan shape of the open portion $\mathbf{40}_{11}$ may be a circular shape whose diameter is about 150 μm. The open portion $\mathbf{40}_{11}$ may be formed by press working, laser processing or the like, for example. The open portion $\mathbf{40}_{11}$ may be formed by exposing and developing the photosensitive insulating layer $\mathbf{40}_1$. In FIG. 5B, the insulating layer $\mathbf{40}_1$ is not illustrated. In FIG. 5B, an area of the metal layer $\mathbf{301}_1$ corresponding to the open portion $\mathbf{40}_{11}$ is illustrated by a dashed line.

Figure 6A:
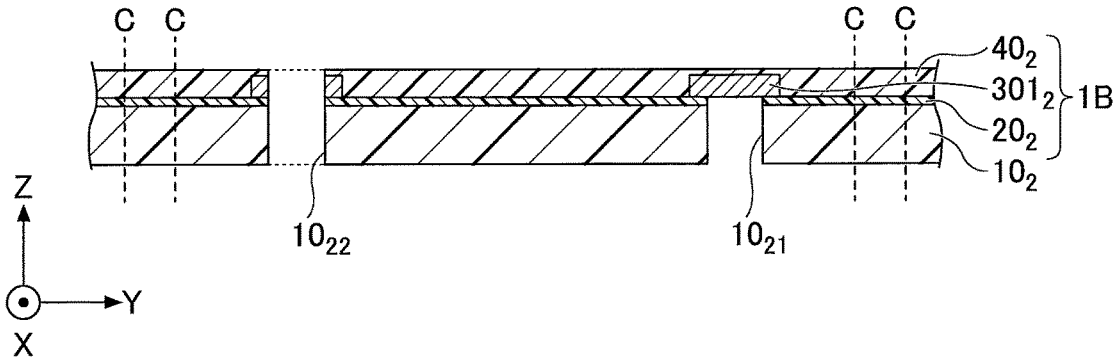
FIG. 6A and FIG. 6B are views illustrating an example of the manufacturing method of the coil substrate of the embodiment.
Figure 6B:
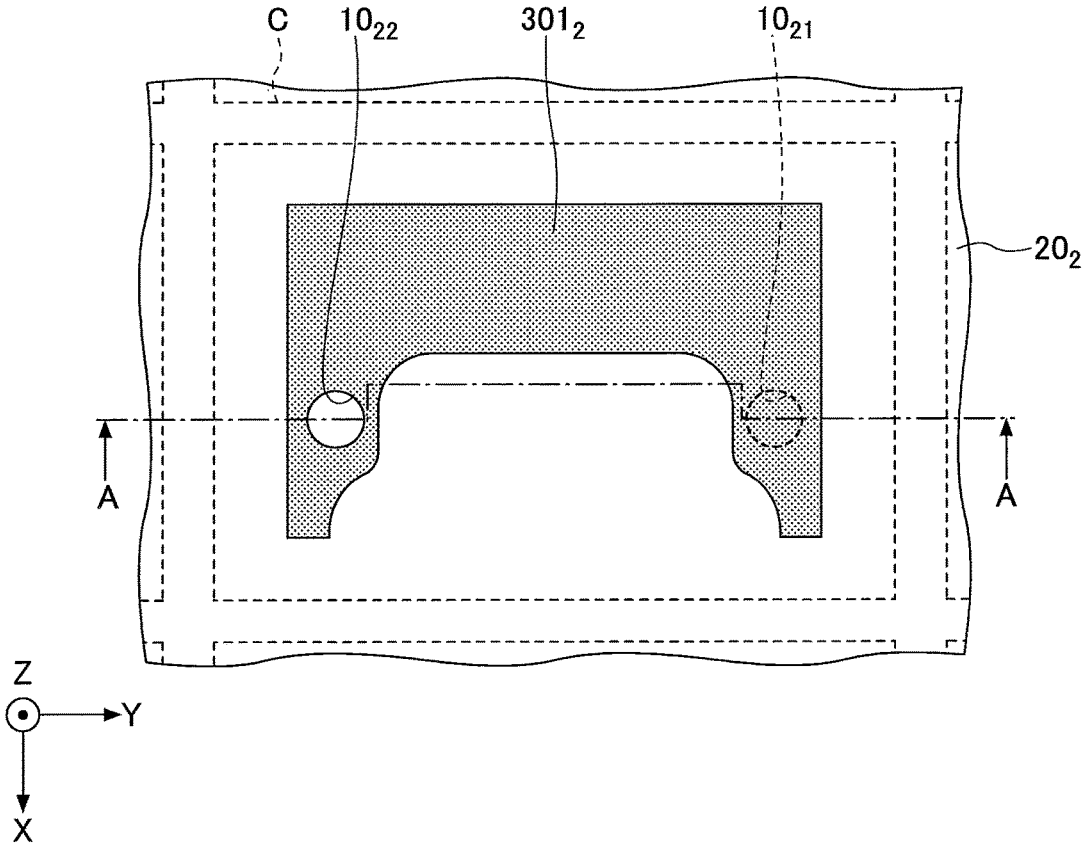

Next, in steps illustrated in FIG. 6A and FIG. 6B (FIG. 6B is a plan view and FIG. 6A is a cross-sectional view of FIG. 6B taken along an A-A line in FIG. 6B), the second structure 1B is formed in which the metal layer $\mathbf{301}_2$ is formed on the substrate $\mathbf{10}_2$ (second substrate). The metal layer $\mathbf{301}_2$ becomes the second wiring $\mathbf{30}_2$ that is the second layer wiring and is a part (about ¾ roll) of the coil after finally shaped (by die cutting or the like). Specifically, after forming the sprocket holes 10*z*, similar to the step illustrated in FIG. 4A and FIG. 4B, the insulating layer $\mathbf{20}_2$ and the metal film $\mathbf{300}_2$ (not illustrated in the drawings) are formed on the substrate $\mathbf{10}_2$ in this order at an area except the both end portions of the substrate $\mathbf{10}_2$ where the sprocket holes 10*z* are formed.

Then, similar to the steps illustrated in FIG. 5A and FIG. 5B, the metal film $\mathbf{300}_2$ is patterned and the metal layer $\mathbf{301}_2$ patterned as illustrated in FIG. 6B is formed on the insulating layer $\mathbf{20}_2$. Thereafter, the metal layer $\mathbf{301}_2$ is covered by the insulating layer $\mathbf{40}_2$. Then, the open portion $\mathbf{10}_{21}$ is formed in the substrate $\mathbf{10}_2$ and the insulating layer $\mathbf{20}_2$ of the second structure 1B that exposes the lower surface of the metal layer $\mathbf{301}_2$. Further, the open portion $\mathbf{10}_{22}$ (through hole) is formed that penetrates the substrate $\mathbf{10}_2$, and the insulating layer $\mathbf{20}_2$, the metal layer $\mathbf{301}_2$ and the insulating layer $\mathbf{40}_2$ of the second structure 1B.

The plan shape of each of the open portions $\mathbf{10}_{21}$ and $\mathbf{10}_{22}$ may be a circular shape whose diameter is about 150 μm. The open portions $\mathbf{10}_{21}$ and $\mathbf{10}_{22}$ may be formed by press working, laser processing or the like. The open portion $\mathbf{10}_{22}$ is formed at a position that overlaps the open portion $\mathbf{40}_{11}$ in a plan view when the first structure 1A and the second structure 1B are stacked with each other in a predetermined direction. Further, in FIG. 6B, the insulating layer $\mathbf{40}_2$ is not illustrated. Further, in FIG. 6B, an area of the metal layer $\mathbf{301}_2$ corresponding to the open portion $\mathbf{10}_{21}$ is illustrated by a dashed line.

The shape, the thickness, the material and the like of the substrate 10*n* and the metal film $\mathbf{300}_n$ (here, "n" is a natural number more than or equal to 2) are the same as those of the substrate $\mathbf{10}_1$ and the metal film $\mathbf{300}_1$ unless otherwise explained.

Figure 7A:
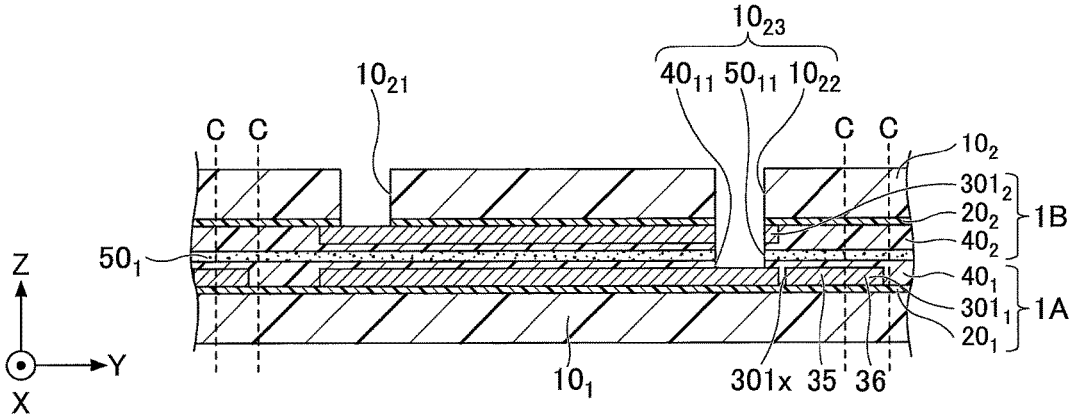
FIG. 7A to FIG. 7C are views illustrating an example of the manufacturing method of the coil substrate of the embodiment.
Figure 7B:
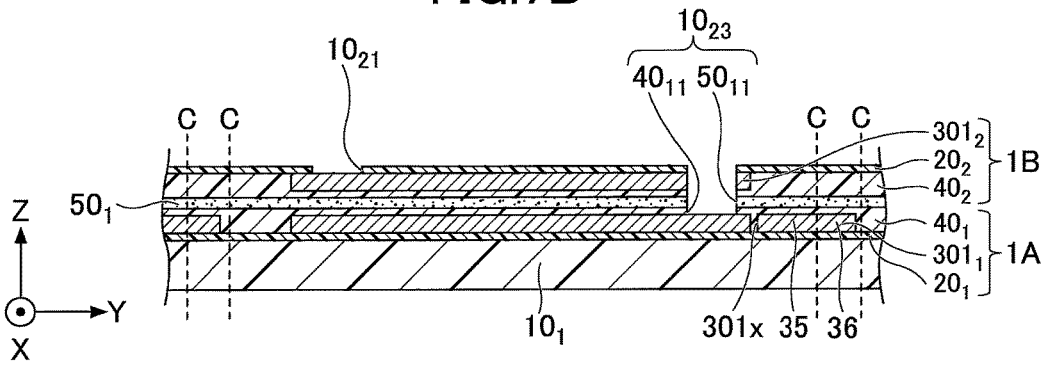
Figure 7C:
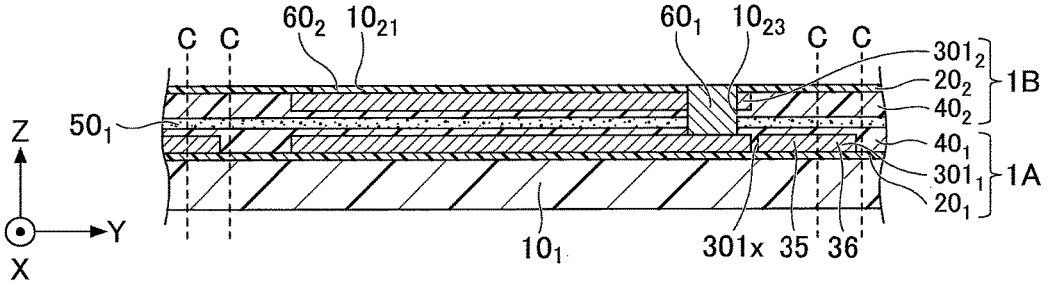

Next, steps illustrated in FIG. 7A to FIG. 7C are explained. FIG. 7A to FIG. 7C are cross-sectional views corresponding to FIG. 5A and FIG. 6A. First, in a step illustrated in FIG. 7A, the adhesion layer $\mathbf{50}_1$ is prepared and the open portion $\mathbf{50}_{11}$ (through hole) that penetrates the adhesion layer $\mathbf{50}_1$ is formed. The open portion $\mathbf{50}_{11}$ may be formed at a position that overlaps the open portions $\mathbf{40}_{11}$ and $\mathbf{10}_{22}$ in a plan view when the first structure 1A and the second structure 1B are stacked with each other through the adhesion layer $\mathbf{50}_1$ in the predetermined direction. For the adhesion layer $\mathbf{50}_1$, heat resistance adhesive (thermosetting) made of insulating resin such as epoxy based adhesive, polyimide based adhesive or the like may be used, for example. The thickness of the adhesion layer $\mathbf{50}_1$ may be about 10 to 40 μm, for example.

Next, the substrate $\mathbf{10}_2$ and the second structure 1B are reversed from the state illustrated in FIG. 6A, and are stacked on the first structure 1A through the adhesion layer $\mathbf{50}_1$. This means that the first structure 1A and the second structure 1B are faced to be stacked while interposing the adhesion layer $\mathbf{50}_1$ such that the substrate $\mathbf{10}_1$ and the substrate $\mathbf{10}_2$ are positioned, outside. Thereafter, the adhesion layer $\mathbf{50}_1$ is cured. At this time, as the open portion $\mathbf{40}_{11}$, the open portion $\mathbf{50}_{11}$ and the open portion $\mathbf{10}_{22}$ are in communication with each other, a single open portion $\mathbf{10}_{23}$ is formed and the upper surface of the metal layer $\mathbf{301}_1$ is exposed at a bottom portion.

Alternatively, in the steps illustrated in FIG. 6A to FIG. 7A, the second structure 1B may be stacked on the first structure 1A through the adhesion layer $\mathbf{50}_1$ before forming the open portions, and thereafter, the open portions $\mathbf{10}_{21}$, $\mathbf{10}_{22}$ and $\mathbf{50}_{11}$ may be provided.

Next, in a step illustrated in FIG. 7B, the substrate $\mathbf{10}_2$ is removed (peeled) from the insulating layer $\mathbf{20}_2$ of the second structure 1B. The substrate $\mathbf{10}_2$ may be mechanically removed from the insulating layer $\mathbf{20}_2$ of the second structure 1B.

Next, in a step illustrated in FIG. 7C, the via wiring $\mathbf{60}_1$ made of copper (Cu) or the like, for example, is formed on the metal layer $\mathbf{301}_1$ that is exposed at the bottom portion of the open portion $10_{23}$. The metal layer $301_1$ and the metal layer $301_2$ are electrically connected in series through the via wiring $60_1$. Further, the via wiring $60_2$ made of copper (Cu) or the like, for example, is formed on the metal layer $301_2$ that is exposed at a bottom portion of the open portion $10_{21}$. The metal layer $301_2$ and the via wiring $60_2$ are electrically connected with each other.

The via wirings $60_1$ and $60_2$ may be formed by depositing copper (Cu) or the like from the metal layers $301_1$ and $301_2$ sides by electroplating in which the bus line 36 is used for supplying power, for example. Further, the via wirings $60_1$ and $60_2$ may be formed by filling metal paste of copper (Cu) or the like on the metal layer $301_1$ that is exposed at the bottom portion of the open portion $10_{23}$ and also filling the metal paste of copper (Cu) or the like on the metal layer $301_2$ that is exposed at the bottom portion of the open portion $10_{21}$. The upper surfaces of the via wirings $60_1$ and $60_2$ may be flush with the upper surface of the insulating layer $20_2$. With this process, in the stacked structure in which the second structure 1B is stacked on the first structure 1A, the metal layer $301_1$, the via wiring $60_1$ and the metal layer $301_2$ are electrically connected in series. Those connected parts become the coil of about one and ¾ rolls after finally shaped (by die cutting or the like).

Figure 8A:
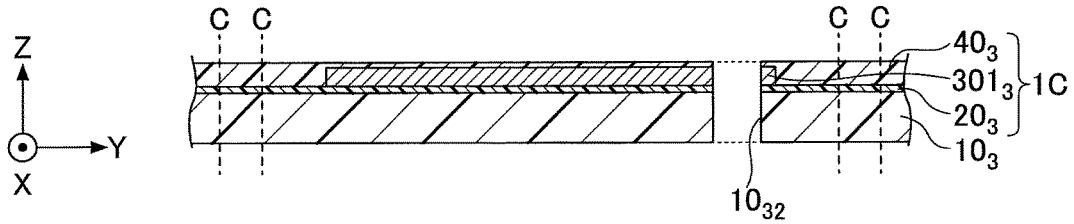
FIG. 8A to FIG. 8C are views illustrating an example of the manufacturing method of the coil substrate of the embodiment.
Figure 8B:
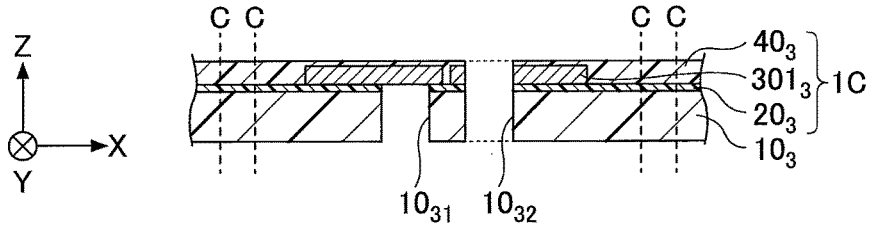
Figure 8C:
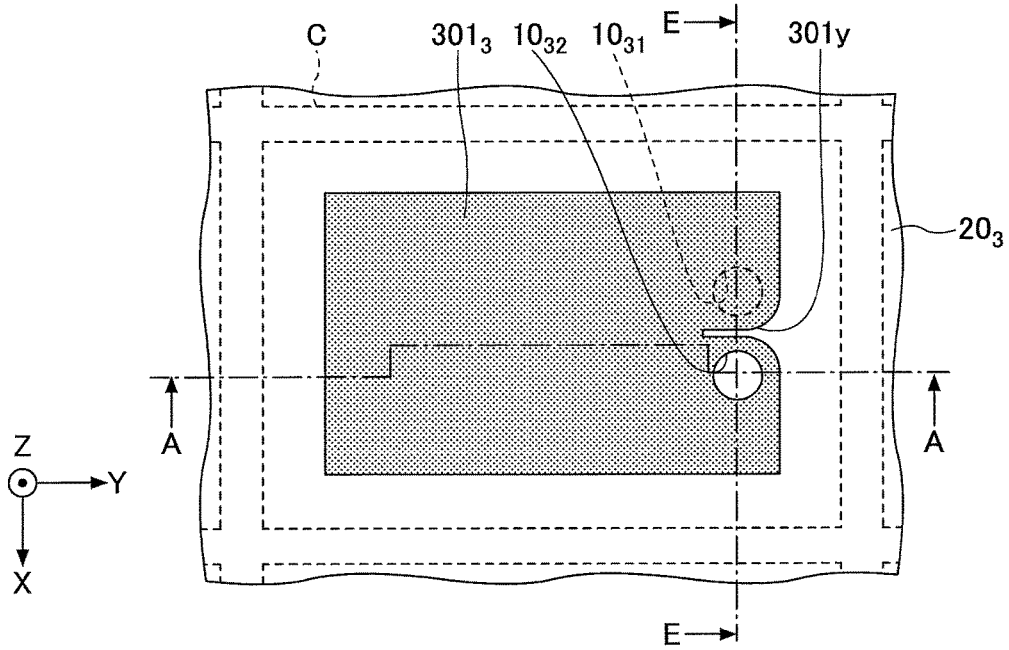

Next, in steps illustrated in FIG. 8A to FIG. 8C, similar to the steps illustrated in FIG. 6A and FIG. 6B, the third structure 1C is formed in which the metal layer $301_3$ is formed on the substrate $10_3$. FIG. 8C is a plan view, FIG. 8A is a cross-sectional view of FIG. 8C taken along an A-A line in FIG. 8C and FIG. 8B is a cross-sectional view of FIG. 8C taken along an E-E line in FIG. 8C. The metal layer $301_3$ becomes the third wiring $30_3$ that is the third layer wiring and is a part (about a roll) of the coil after finally shaped (by die cutting or the like). The metal layer $301_3$ is provided with a slit portion 301*y*. The slit portion 301*y* is provided to facilitate forming the spiral shape of the coil when shaping (die cutting or the like) the coil substrate 1 in the following step.

Next, the open portion $10_{31}$ is formed in the substrate $10_3$ and the insulating layer $20_3$ of the third structure 1C that exposes the lower surface of the metal layer $301_3$. Further, the open portion $10_{32}$ (through hole) is formed that penetrates the substrate $10_3$, and the insulating layer $20_3$, the metal layer $301_3$ and the insulating layer $40_3$ of the third structure 1C.

The plan shape and the method of forming the open portions $10_{31}$ and $10_{32}$ may be the same as those of the open portion $10_{21}$ or the like, for example. The open portion $10_{32}$ is formed at a position that overlaps the open portion $10_{21}$ in a plan view when the second structure 12 and the third structure 1C are stacked with each other in the predetermined direction. The insulating layer $40_3$ is not illustrated in FIG. 8C. Further, in FIG. 8C, an area of the metal layer $301_3$ corresponding to the open portion $10_{31}$ is illustrated by a dashed line.

Figure 9A:
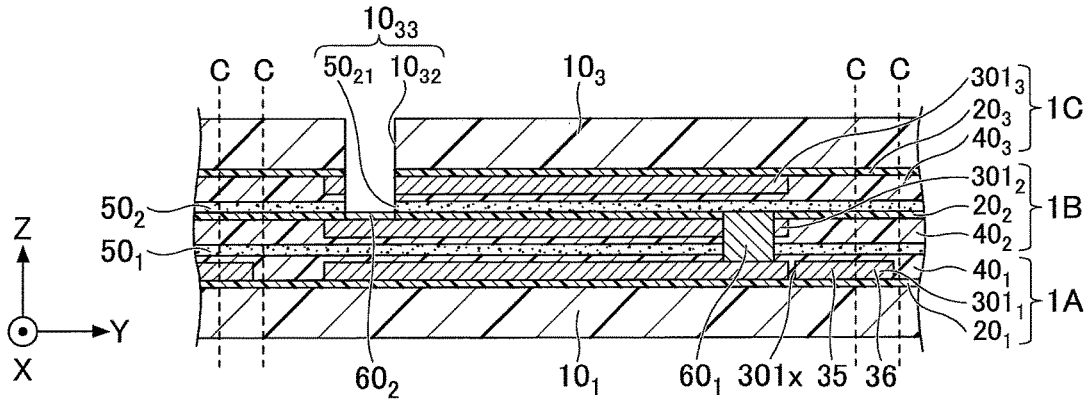
FIG. 9A to FIG. 9C are views illustrating an example of the manufacturing method of the coil substrate of the embodiment.
Figure 9B:
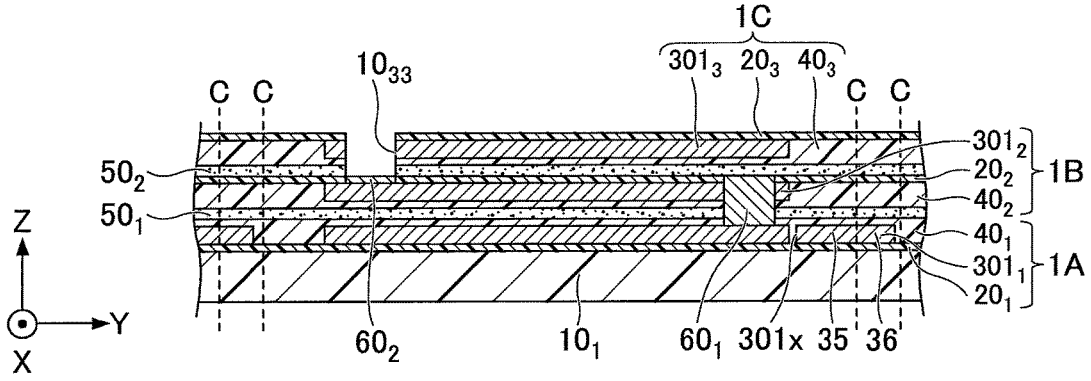
Figure 9C:
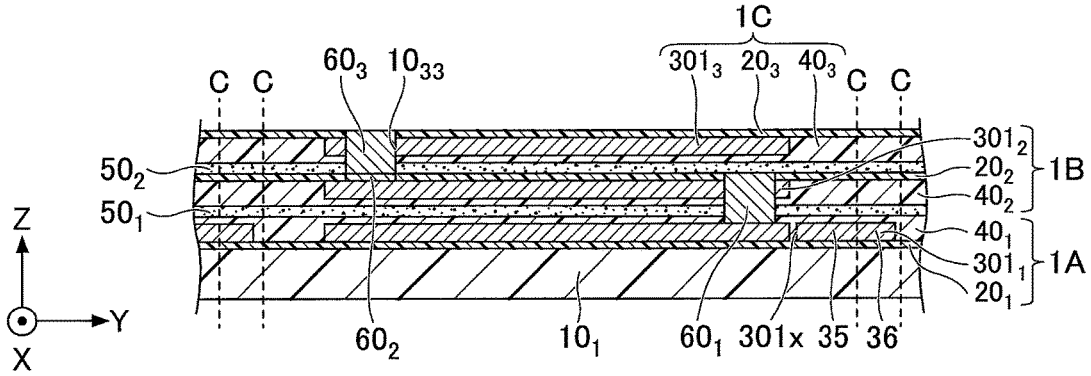

Next, steps illustrated in FIG. 9A to FIG. 9C are explained. FIG. 9A to FIG. 9C are cross-sectional views corresponding to FIG. 7C. First, in a step illustrated in FIG. 9A, the adhesion layer $50_2$ is prepared and the open portion $50_{21}$ (through hole) that penetrates the adhesion layer $50_2$ is formed. The open portion $50_{21}$ is formed at a position that overlaps the via wiring $60_2$ in a plan view when the second structure 1B and the third structure 1C are stacked with each other through the adhesion layer $50_2$ in the predetermined direction. The shape, the thickness, the material and the like of an adhesion layer 50*n* (here, "n" is a natural number more than or equal to 2) are the same as those of the adhesion layer $50_1$ unless otherwise explained.

Next, the substrate $10_3$ and the third structure 1C are reversed from the state illustrated in FIG. 8A, and are stacked on the second structure 1B through the adhesion layer $50_2$. This means that the second structure 1B and the third structure 1C are faced to be stacked while interposing the adhesion layer $50_2$ such that the substrate $10_1$ and the substrate $10_3$ are positioned outside. Thereafter, the adhesion layer $50_2$ is cured. At this time, as the open portion $50_{21}$ and the open portion $10_{32}$ are in communication with each other, a single open portion $10_{33}$ is formed and the upper surface of the via wiring $60_2$ is exposed at a bottom portion.

Alternatively, in the steps illustrated in FIG. 8A to FIG. 9A, the third structure 1C may be stacked on the second structure 1B through the adhesion layer $50_2$ before forming the open portions, and thereafter, the open portions $10_{31}$, $10_{32}$ and $50_{21}$ may be provided.

Next, in a step illustrated in FIG. 9B, the substrate $10_3$ is removed (peeled) from the insulating layer $20_3$ of the third structure 1C.

Next, in a step illustrated in FIG. 9C, the via wiring $60_3$ is formed on the via wiring $60_2$ that is exposed at the bottom portion of the open portion $10_{33}$. The metal layer $301_2$ and the metal layer $301_3$ are electrically connected in series through the via wirings $60_2$ and $60_3$. Further, the via wiring $60_4$ (not illustrated in the drawings) is formed on the metal layer $301_3$ that is exposed at the bottom portion of the open portion $10_{31}$ (not illustrated in the drawings). The metal layer $301_3$ and the via wiring $60_4$ are electrically connected with each other.

The via wirings $60_3$ and $60_4$ may be formed by electroplating in which the bus line 36 is used for supplying power or by filling metal paste, similar to the via wiring $60_1$. For the material of the via wirings $60_3$ and $60_4$, copper (Cu) or the like may be used, for example. The upper surfaces of the via wirings $60_3$ and $60_4$ may be flush with the upper surface of the insulating layer $20_3$. With this process, in the stacked structure in which the first structure 1A to the third structure 1C are stacked, the metal layers $301_1$, $301_2$ and $301_3$ are electrically connected in series through the via wirings. Those connected parts become the coil of about two and ¾ rolls after finally shaped (by die cutting or the like).

Figure 10A:
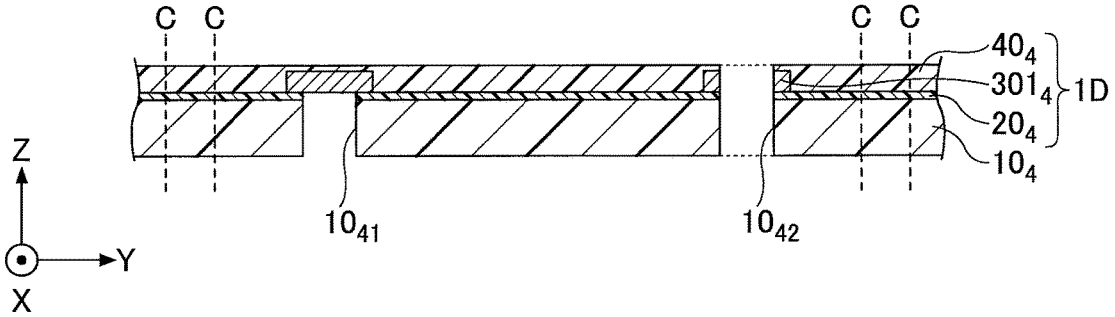
FIG. 10A and FIG. 10B are views illustrating an example of the manufacturing method of the coil substrate of the embodiment.
Figure 10B:
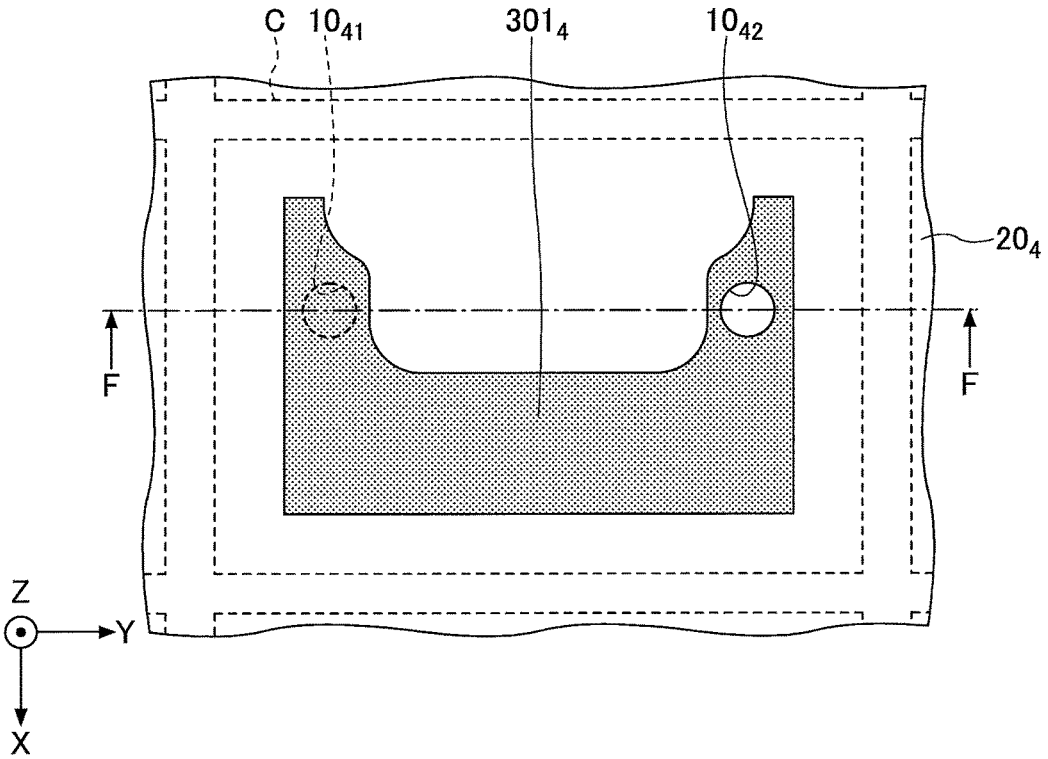

Next, in steps illustrated in FIG. 10A and FIG. 10B (FIG. 10B is a plan view and FIG. 10A is a cross-sectional view of FIG. 10B taken along an F-F line in FIG. 10B), similar to the steps illustrated in FIG. 6A and FIG. 6B, the fourth structure 1D is formed in which the metal layer $301_4$ is formed on the substrate $10_4$. The metal layer $301_4$ becomes the fourth wiring $30_4$ that is the fourth layer wiring and is a part (about ¾ roll) of the coil after finally shaped (by die cutting or the like).

Next, the open portion $10_{41}$ is formed in the substrate $10_4$ and the insulating layer $20_4$ of the fourth structure 1D that exposes the lower surface of the metal layer $301_4$. Further, the open portion $10_{42}$ (through hole) is formed that penetrates the substrate $10_4$, and the insulating layer $20_4$, the metal layer $301_4$ and the insulating layer $40_4$ of the fourth structure 1D.

The plan shape and the method of forming the open portions $10_{41}$ and $10_{42}$ may be the same as those of the open portion $10_{21}$ or the like. The open portion $10_{42}$ is formed at a position that overlaps the via wiring $60_4$ in a plan view when the third structure 1C and the fourth structure 1D are stacked with each other in the predetermined direction. Here, the insulating layer $40_4$ is not illustrated in FIG. 10B.

Further, in FIG. 10B, an area corresponding to the open portion $\mathbf{10}_{41}$ of the metal layer $\mathbf{301}_4$ are illustrated by a dashed line.

Figure 11A:
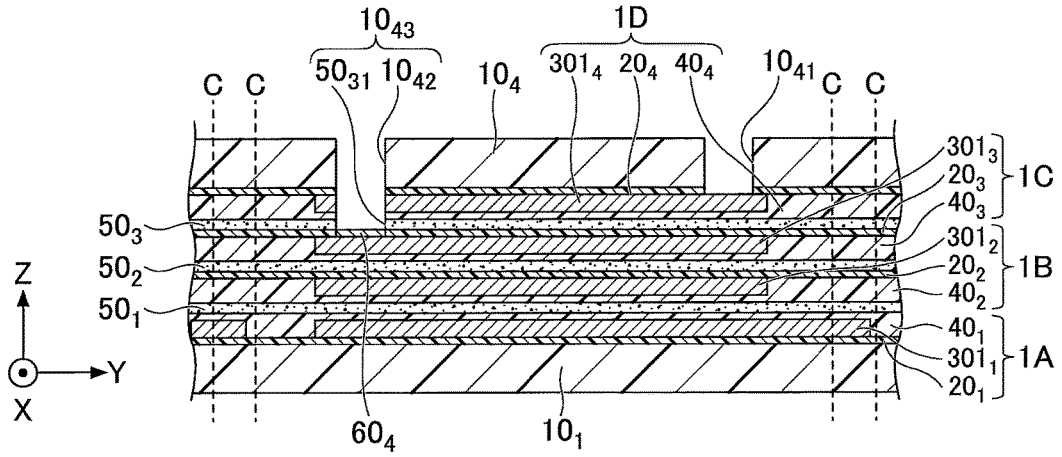
FIG. 11A to FIG. 11C are views illustrating an example of the manufacturing method of the coil substrate of the embodiment.
Figure 11B:
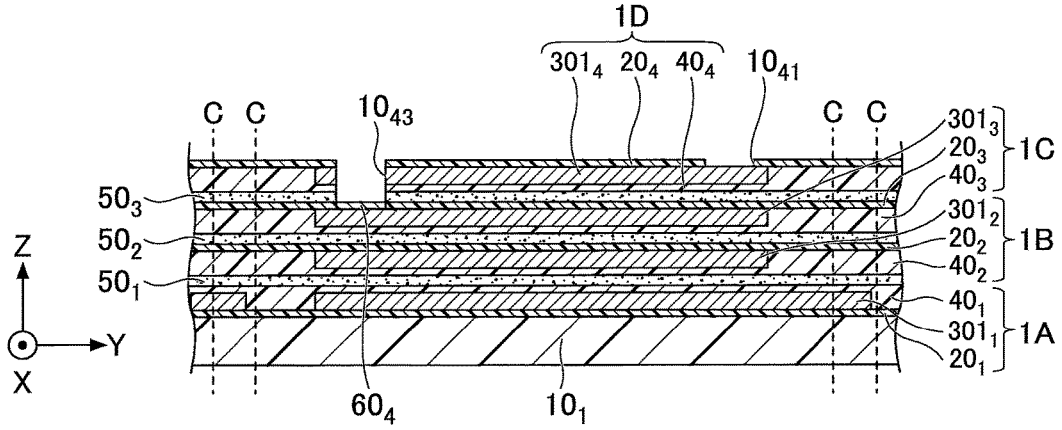
Figure 11C:
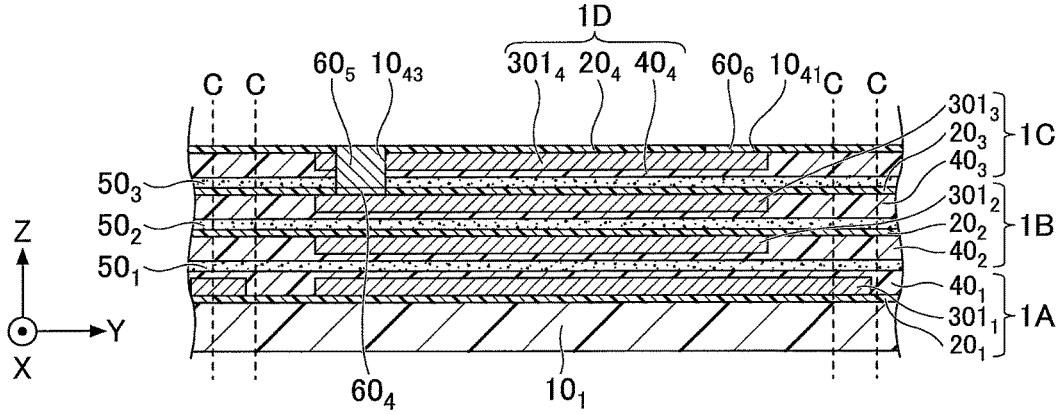

Next, steps illustrated in FIG. 11A to FIG. 11C are explained. FIG. 11A to FIG. 11C are cross-sectional views corresponding to FIG. 9C and FIG. 10A. First, in a step illustrated in FIG. 11A, the adhesion layer $\mathbf{50}_3$ is prepared, and the open portion $\mathbf{50}_{31}$ (through hole) that penetrates the adhesion layer $\mathbf{50}_3$ is formed. The open portion $\mathbf{50}_{31}$ is formed at a position that overlaps the via wiring $\mathbf{60}_4$ in a plan view when the third structure 1C and the fourth structure 1D are stacked with each other through the adhesion layer $\mathbf{50}_3$ in the predetermined direction.

Next, the substrate $\mathbf{10}_4$ and the fourth structure 1D are reversed from the state illustrated in FIG. 10A, and are stacked on the third structure 10 through the adhesion layer $\mathbf{50}_3$. This means that the third structure 1C and the fourth structure 1D are faced to be stacked while interposing the adhesion layer $\mathbf{50}_3$ such that the substrate $\mathbf{10}_1$ and the substrate $\mathbf{10}_4$ are positioned outside. Thereafter, the adhesion layer $\mathbf{50}_3$ is cured. At this time, as the open portion $\mathbf{50}_{31}$ and the open portion $\mathbf{10}_{42}$ are in communication with each other, a single open portion $\mathbf{10}_{43}$ is formed and the upper surface of the via wiring $\mathbf{60}_4$ is exposed at a bottom portion.

Alternatively, in the steps illustrated FIG. 10A to FIG. 11A, the fourth structure 1D may be stacked on the third structure 1C through the adhesion layer $\mathbf{50}_3$ before forming the open portions, and thereafter, the open portions $\mathbf{10}_{41}$, $\mathbf{10}_{42}$ and $\mathbf{50}_{31}$ may be formed.

Next, in a step illustrated in FIG. 11B, the substrate $\mathbf{10}_4$ is removed (peeled) from the insulating layer $\mathbf{20}_4$ of the fourth structure 1D.

Next, in a step illustrated in FIG. 11C, the via wiring $\mathbf{60}_5$ is formed on the via wiring $\mathbf{60}_4$ that is exposed at the bottom portion of the open portion $\mathbf{10}_{43}$. The metal layer $\mathbf{301}_3$ and the metal layer $\mathbf{301}_4$ are electrically connected in series through the via wirings $\mathbf{60}_4$ and $\mathbf{60}_5$. Further, the via wiring $\mathbf{60}_6$ is formed on the metal layer $\mathbf{301}_4$ that is exposed at the bottom portion of the open portion $\mathbf{10}_{41}$. The metal layer $\mathbf{301}_4$ and the via wiring $\mathbf{60}_6$ are electrically connected with each other.

The via wirings $\mathbf{60}_5$ and $\mathbf{60}_6$ may be formed by electroplating in which the bus line 36 is used for supplying power or by filling metal paste, similar to the via wiring $\mathbf{60}_1$ or the like. For the material of the via wirings $\mathbf{60}_5$ and $\mathbf{60}_5$, copper (Cu) or the like may be used, for example. The upper surfaces of the via wirings $\mathbf{60}_5$ and $\mathbf{60}_6$ may be flush with the upper surface of the insulating layer $\mathbf{20}_4$. With this process, in the stacked structure in which the first structure 1A to the fourth structure 1D are stacked, the metal layers $\mathbf{301}_1$, $\mathbf{301}_2$, $\mathbf{301}_3$ and $\mathbf{301}_4$ are electrically connected in series through the via wirings. Those connected parts become the coil of about three rolls after finally shaped (by die cutting or the like).

Figure 12A:
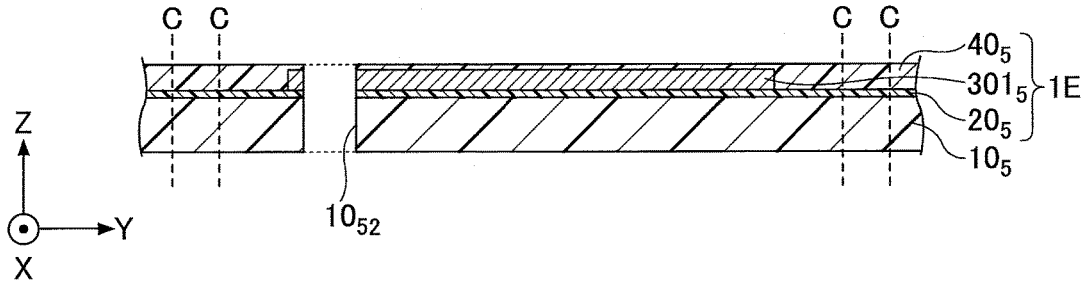
FIG. 12A to FIG. 12C are views illustrating an example of the manufacturing method of the coil substrate of the embodiment.
Figure 12B:
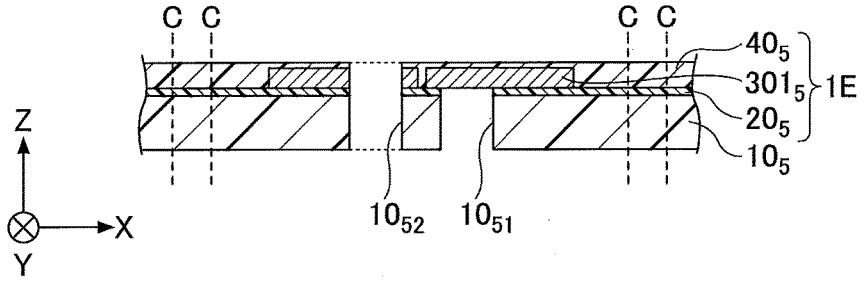
Figure 12C:
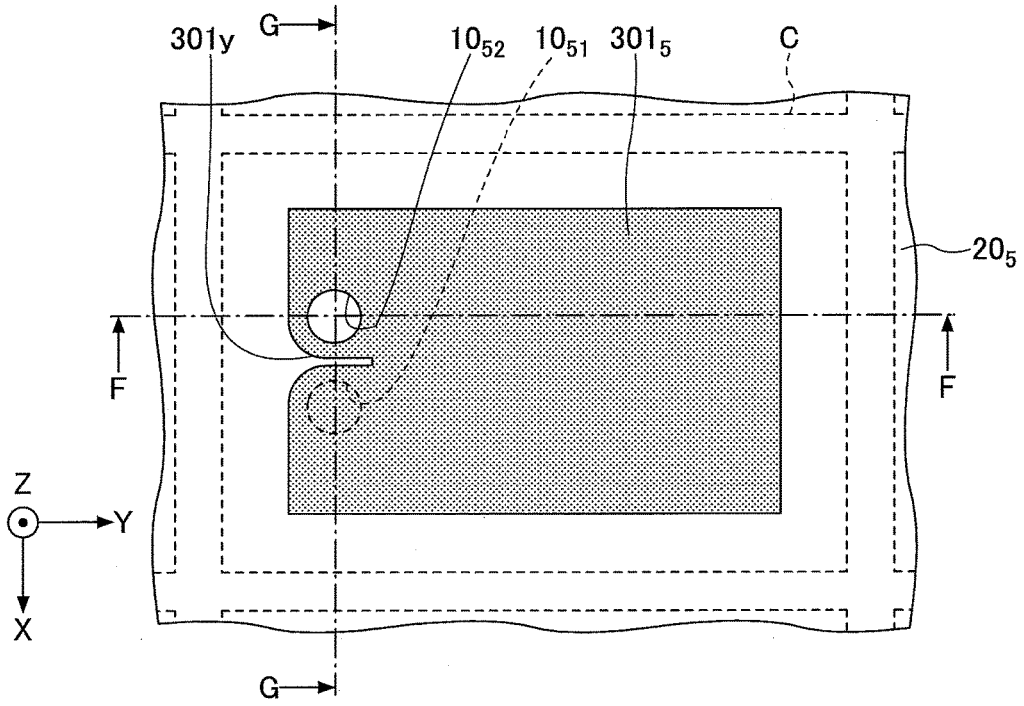

Next, in steps illustrated in FIG. 12A to FIG. 12C, similar to the steps illustrated in FIG. 6A and FIG. 6B, the fifth structure 1E is formed in which the metal layer $\mathbf{301}_5$ is formed on the substrate $\mathbf{10}_5$. FIG. 12C is a plan view, FIG. 12A is a cross-sectional view of FIG. 12C taken along an F-F line in FIG. 12C, and FIG. 12B is a cross-sectional view of FIG. 12C taken along a G-G line in FIG. 12C. The metal layer $\mathbf{301}_5$ becomes the fifth wiring $\mathbf{30}_5$ that is the fifth layer wiring and a part (about a roll) of the coil after finally shaped (by die cutting or the like). The metal layer $\mathbf{301}_5$ is provided with a slit portion $\mathbf{301}y$. The slit portion $\mathbf{301}y$ is provided to facilitate forming the spiral shape of the coil when shaping (die cutting or the like) the coil substrate 1 in the following step.

Next, the open portion $\mathbf{10}_{51}$ is formed in the substrate $\mathbf{10}_5$ and the insulating layer $\mathbf{20}_5$ of the fifth structure 1E that exposes the lower surface of the metal layer $\mathbf{301}_5$. Further, the open portion $\mathbf{10}_{52}$ (through hole) is formed that penetrates the substrate $\mathbf{10}_5$, and the insulating layer $\mathbf{20}_5$, the metal layer $\mathbf{301}_5$ and the insulating layer $\mathbf{40}_5$ of the fifth structure 1E.

The plan shape and the method of forming the open portions $\mathbf{10}_{51}$ and $\mathbf{10}_{52}$ may be the same as those of the open portion $\mathbf{10}_{21}$ or the like, for example. The open portion $\mathbf{10}_{52}$ is formed at a position that overlaps the open portion $\mathbf{50}_{41}$ in a plan view when the fourth structure 1D and the fifth structure 1E are stacked with each other in the predetermined direction. The insulating layer $\mathbf{40}_5$ is not illustrated in FIG. 12C. Further, in FIG. 12C, an area corresponding to the open portion $\mathbf{10}_{51}$ of the metal layer $\mathbf{301}_5$ is illustrated by a dashed line.

Figure 13A:
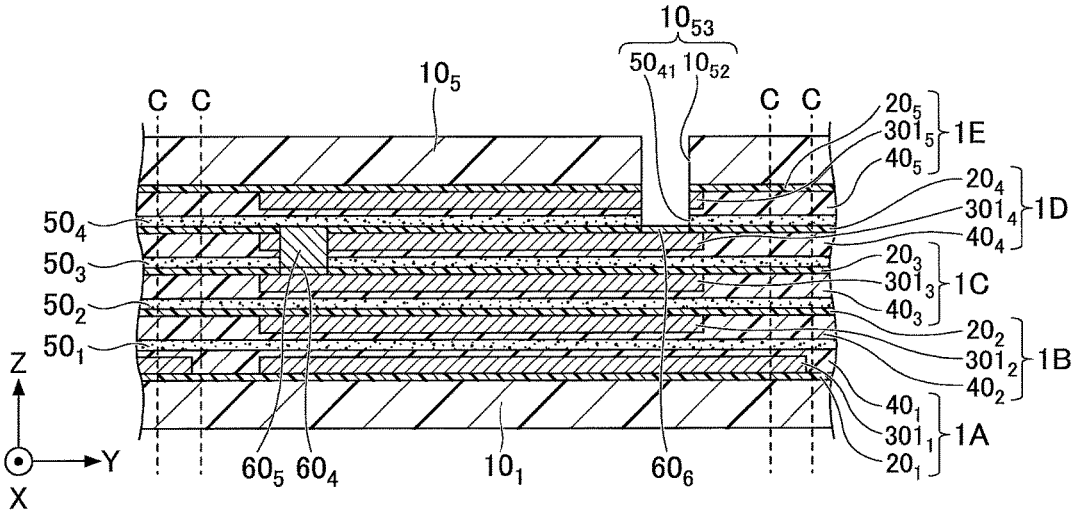
FIG. 13A to FIG. 13C are views illustrating an example of the manufacturing method of the coil substrate of the embodiment.
Figure 13B:
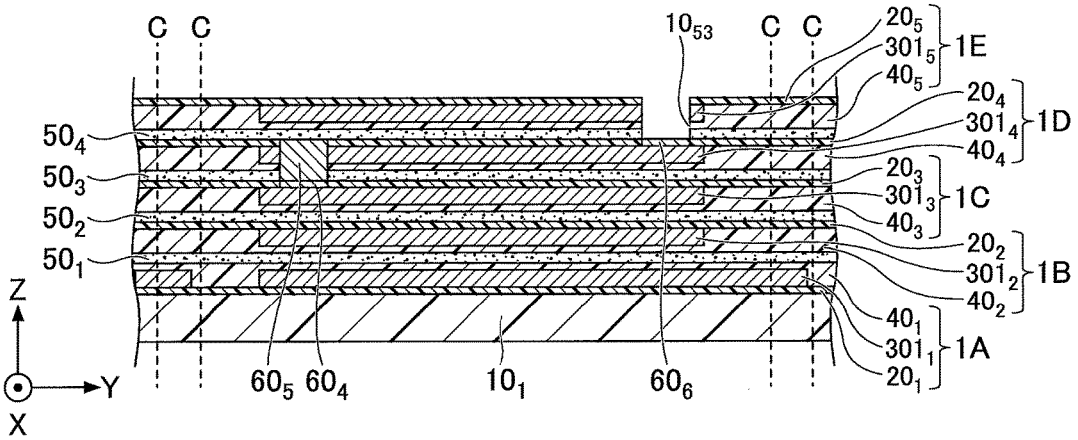
Figure 13C:
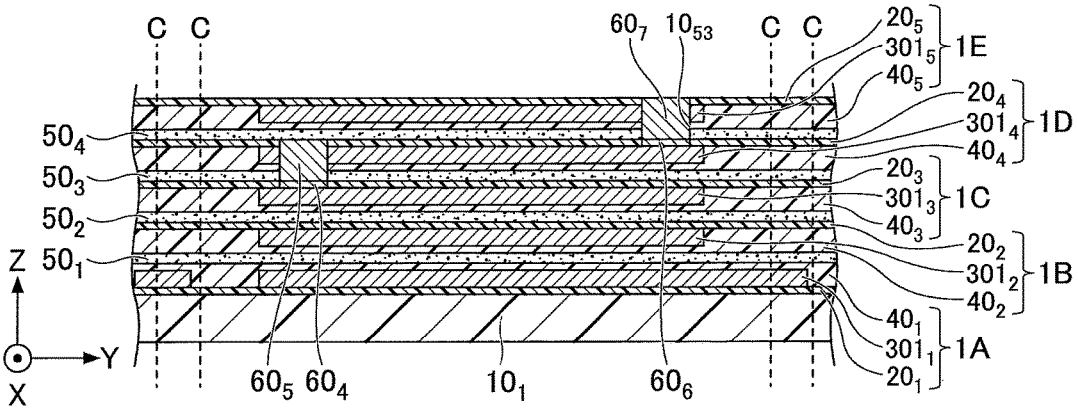

Next, steps illustrated in FIG. 13A to FIG. 13C are explained. FIG. 13A to FIG. 13C are cross-sectional views corresponding to FIG. 11C and FIG. 12A. First, in a step illustrated in FIG. 13A, the adhesion layer $\mathbf{50}_4$ is prepared and the open portion $\mathbf{50}_{41}$ (through hole) that penetrates the adhesion layer $\mathbf{50}_4$ is formed. The open portion $\mathbf{50}_{41}$ is formed at a position that overlaps the via wiring $\mathbf{60}_6$ in a plan view when the fourth structure 1C and the fifth structure 1E are stacked with each other through the adhesion layer $\mathbf{50}_4$ in the predetermined direction.

Next, the substrate $\mathbf{10}_5$ and the fifth structure 1E are reversed from the state illustrated in FIG. 12A, and are stacked on the fourth structure 1D vie the adhesion layer $\mathbf{50}_4$. This means that the fourth structure 1D and the fifth structure 1E are faced to be staked while interposing the adhesion layer $\mathbf{50}_4$ such that the substrate $\mathbf{10}_1$ and the substrate $\mathbf{10}_5$ are positioned outside. Thereafter, the adhesion layer $\mathbf{50}_4$ is cured. At this time, as the open portion $\mathbf{50}_{41}$ and the open portion $\mathbf{10}_{52}$ are in communication with each other, a single open portion $\mathbf{10}_{53}$ is formed and the upper surface of the via wiring $\mathbf{60}_6$ is exposed at a bottom portion.

Alternatively, in the steps illustrated in FIG. 12A to FIG. 13A, the fifth structure 1E may be stacked on the fourth structure 1D through the adhesion layer $\mathbf{50}_4$ before forming the open portions, and thereafter, the open portions $\mathbf{10}_{51}$, $\mathbf{10}_{52}$ and $\mathbf{50}_{41}$ may be formed.

Next, in a step illustrated in FIG. 13B, the substrate $\mathbf{10}_5$ is removed (peeled) from the insulating layer $\mathbf{20}_5$ of the fifth structure 1E.

Next, in a step illustrated in FIG. 13C, the via wiring $\mathbf{60}_7$ is formed on the via wiring $\mathbf{60}_6$ that is exposed at the bottom portion of the open portion $\mathbf{10}_{53}$. The metal layer $\mathbf{301}_5$ and the metal layer $\mathbf{301}_4$ are electrically connected in series through the via wirings $\mathbf{60}_6$ and $\mathbf{60}_7$. Further, the via wiring $\mathbf{60}_8$ (not illustrated in the drawings) is formed on the metal layer $\mathbf{301}_5$ that is exposed at the bottom portion of the open portion $\mathbf{10}_{51}$ (not illustrated in the drawings). The metal layer $\mathbf{301}_5$ and the via wiring $\mathbf{60}_8$ are electrically connected with each other.

The via wirings $\mathbf{60}_7$ and $\mathbf{60}_8$ may be formed by electroplating in which the bus line 36 is used for supplying power or by filling metal paste, similar to the via wiring $\mathbf{60}_1$ or the like. For the material of the via wirings $\mathbf{60}_7$ and $\mathbf{60}_8$, copper (Cu) or the like may be used, for example. The upper surfaces of the via wirings $\mathbf{60}_7$ and $\mathbf{60}_8$ may be flush with the upper surface of the insulating layer $\mathbf{20}_5$. With this process, in the stacked structure in which the first structure 1A to the fifth structure 1E are stacked, the metal layers $\mathbf{301}_1$, $\mathbf{301}_2$, $\mathbf{301}_3$, $\mathbf{301}_4$ and $\mathbf{301}_5$ are electrically connected in series through the via wirings. Those connected parts become the coil of about four rolls after finally shaped (by die cutting or the like).

Figure 14A:
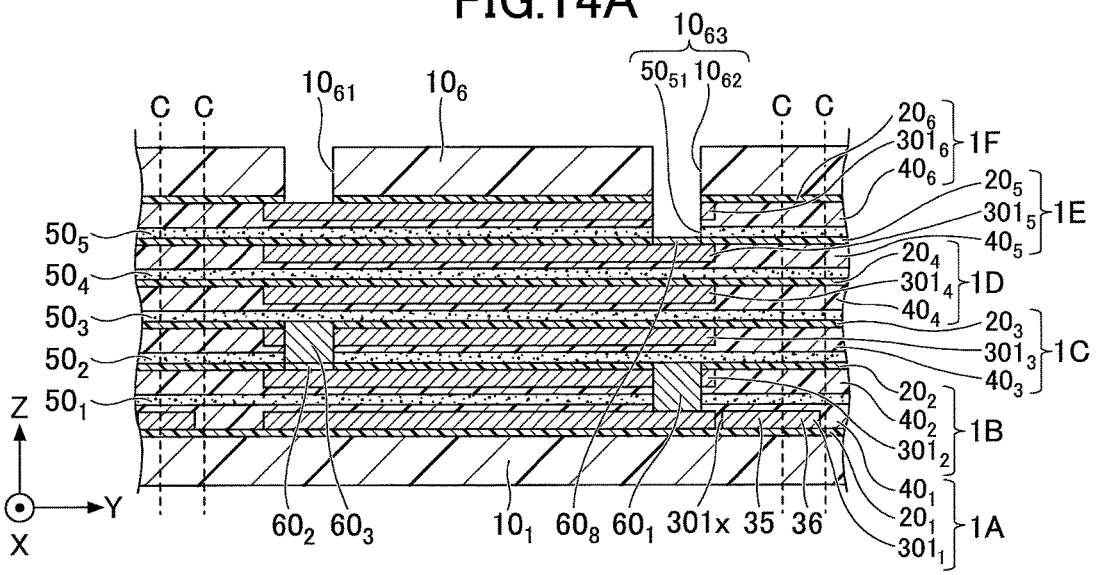
FIG. 14A to FIG. 14C are views illustrating an example of the manufacturing method of the coil substrate of the embodiment.
Figure 14B:
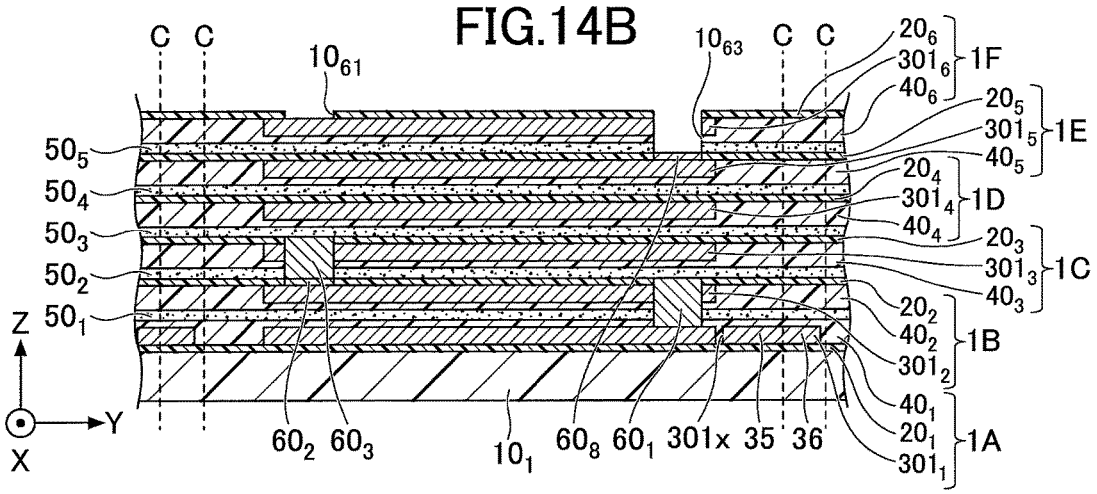
Figure 14C:
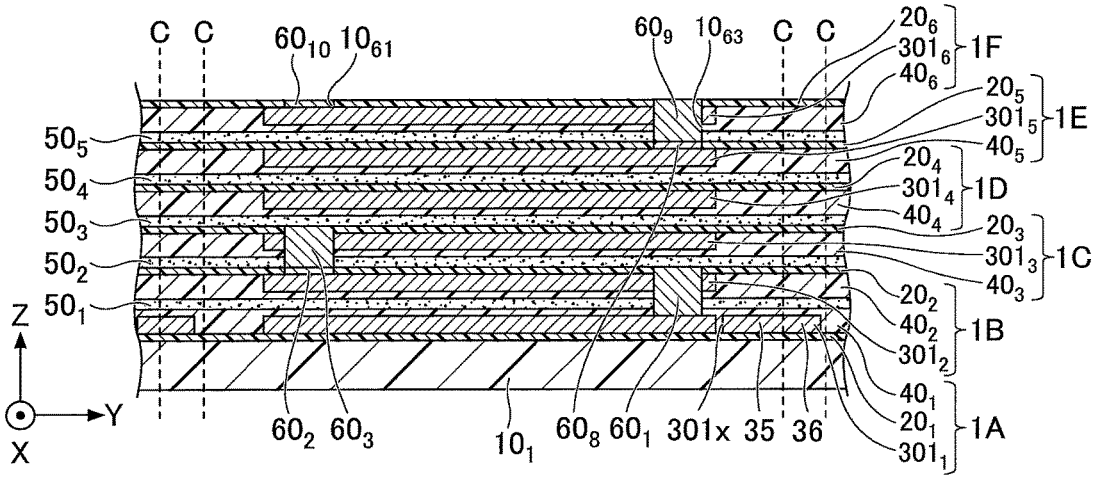

Next, steps illustrated in FIG. 14A to FIG. 14C are explained. FIG. 14A to FIG. 14C are cross-sectional views corresponding to FIG. 13C. First, in a step illustrated in FIG. 14A, the sixth structure 1F is formed in which the metal layer $\mathbf{301}_6$ is formed on the substrate $\mathbf{10}_6$. The metal layer $\mathbf{301}_6$ becomes the sixth wiring $\mathbf{30}_6$ that is the sixth layer wiring and is a part (about ¾ roll) of the coil after finally shaped (by die cutting or the like). Then, the open portion $\mathbf{10}_{61}$ is formed in the substrate $\mathbf{10}_6$ and the insulating layer $\mathbf{20}_6$ of the sixth structure 1F that exposes the lower surface of the metal layer $\mathbf{301}_6$. Further, the open portion $\mathbf{10}_{62}$ (through hole) is formed that penetrates the substrate $\mathbf{10}_6$, and the insulating layer $\mathbf{20}_6$, the metal layer $\mathbf{301}_6$ and the insulating layer $\mathbf{40}_6$ of the sixth structure 1F. Although the reference numerals are different in the sixth structure 1F and the second structure 1B, the sixth structure 1F has the same structure as the second structure 1B and the open portions $\mathbf{10}_{61}$ and $\mathbf{10}_{62}$ respectively correspond to the open portions $\mathbf{10}_{21}$ and $\mathbf{10}_{22}$.

Next, the adhesion layer $\mathbf{50}_5$ is prepared and the open portion $\mathbf{50}_{51}$ (through hole) is formed that penetrates the adhesion layer $\mathbf{50}_5$. The open portion $\mathbf{50}_{51}$ is formed at a position that overlaps the via wiring $\mathbf{60}_8$ in a plan view when the sixth structure 1F and the fifth structure 1E are stacked with each other through the adhesion layer $\mathbf{50}_5$ in the predetermined direction. Then, similar to FIG. 7A, the substrate $\mathbf{10}_6$ and the sixth structure 1F are reversed from the state illustrated in FIG. 6A, and are stacked on the fifth structure 1E through the adhesion layer $\mathbf{50}_5$. This means that the fifth structure 1E and the sixth structure 1F are faced to be stacked while interposing the adhesion layer $\mathbf{50}_5$ such that the substrate $\mathbf{10}_1$ and the substrate $\mathbf{10}_6$ are positioned outside. Thereafter, the adhesion layer $\mathbf{50}_5$ is cured. At this time, as the open portion $\mathbf{50}_{51}$ and the open portion $\mathbf{10}_{62}$ are in communication with each other, a single open portion $\mathbf{10}_{63}$ is formed and the upper surface of the via wiring $\mathbf{60}_8$ is exposed at a bottom portion.

Alternatively, in the steps illustrated in FIG. 6A, FIG. 6B and FIG. 14A, the sixth structure 1F may be stacked on the fifth structure 1E through the adhesion layer $\mathbf{50}_5$ before forming the open portions, and thereafter, the open portions $\mathbf{10}_{61}$, $\mathbf{10}_{62}$ and $\mathbf{50}_{51}$ may be formed.

Next, in a step illustrated in FIG. 14B, the substrate $\mathbf{10}_6$ is removed (peeled) from the insulating layer $\mathbf{20}_6$ of the sixth structure 1F.

Next, in a step illustrated in FIG. 14C, the via wiring $\mathbf{60}_9$ is formed on the via wiring $\mathbf{60}_8$ that is exposed at the bottom portion of the open portion $\mathbf{10}_{63}$. The metal layer $\mathbf{301}_5$ and the metal layer $\mathbf{301}_6$ are electrically connected in series through the via wirings $\mathbf{60}_8$ and $\mathbf{60}_9$. Further, the via wiring $\mathbf{60}_{10}$ is formed on the metal layer $\mathbf{301}_6$ that is exposed at the bottom portion of the open portion $\mathbf{10}_{61}$. The metal layer $\mathbf{301}_6$ and the via wiring $\mathbf{60}_{10}$ are electrically connected with each other.

The via wirings $\mathbf{60}_9$ and $\mathbf{60}_{10}$ may be formed by electroplating in which the bus line 36 is used for supplying power or by filling metal paste, similar to the via wiring $\mathbf{60}_1$ or the like. For the material of the via wirings $\mathbf{60}_9$ and $\mathbf{60}_{10}$, copper (Cu) or the like may be used, for example. The upper surfaces of the via wirings $\mathbf{60}_9$ and $\mathbf{60}_{10}$ may be flush with the upper surface of the insulating layer $\mathbf{20}_6$. With this process, in the stacked structure in which the first structure 1A to the sixth structure 1F are stacked, the metal layers $\mathbf{301}_1$, $\mathbf{301}_2$, $\mathbf{301}_3$, $\mathbf{301}_4$, $\mathbf{301}_5$ and $\mathbf{301}_6$ are electrically connected in series through the via wirings. Those connected parts become the coil of about four and ¾ rolls after finally shaped (by die cutting or the like).

Figure 15A:
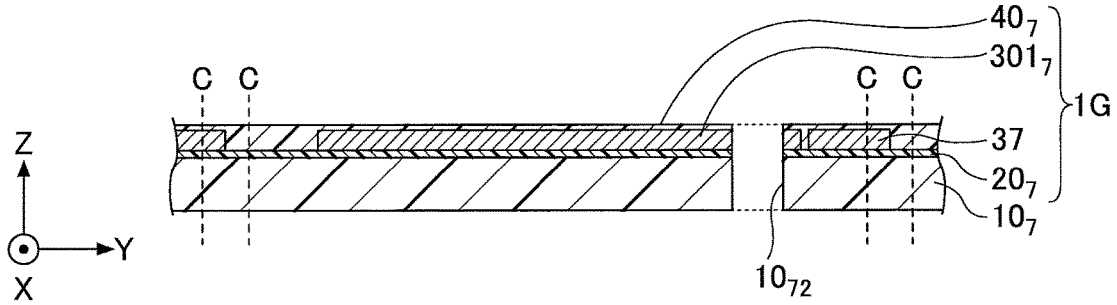
FIG. 15A and FIG. 15B are views illustrating an example of the manufacturing method of the coil substrate of the embodiment.
Figure 15B:
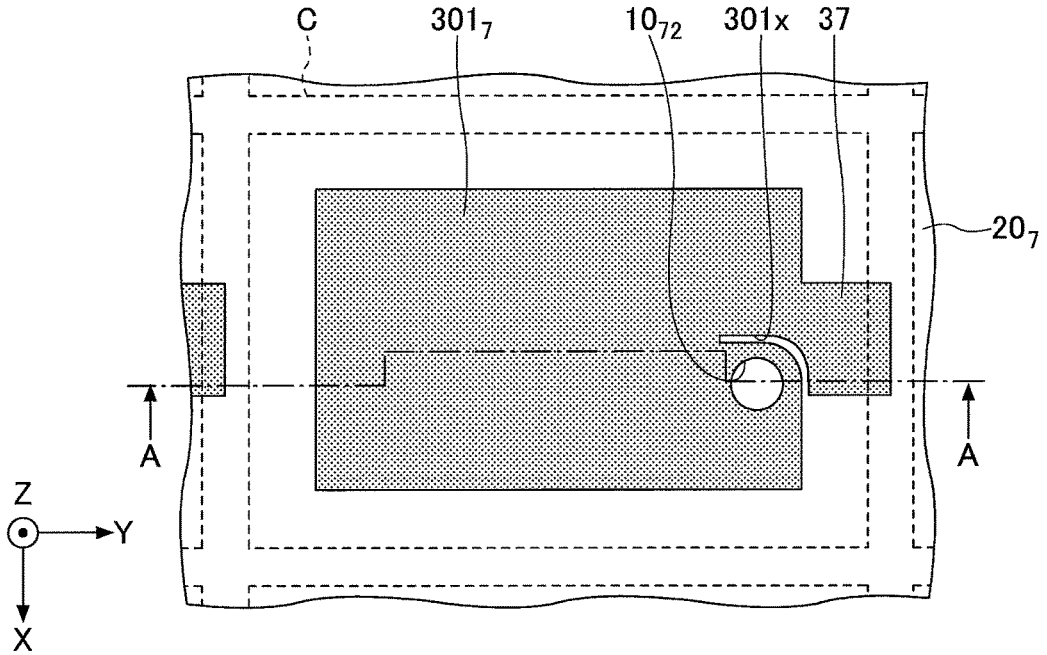

Next, in steps illustrated in FIG. 15A and FIG. 15B, similar to the steps illustrated in FIG. 6A and FIG. 6B, the seventh structure 1G is formed in which the metal layer $\mathbf{301}_7$ is formed on the substrate $\mathbf{10}_7$. The metal layer $\mathbf{301}_7$ becomes the seventh wiring $\mathbf{30}_7$ that is the seventh layer wiring and is a part (about a roll) of the coil after finally shaped (by die cutting or the like). Specifically, the metal layer $\mathbf{301}_7$ is formed on the insulating layer $\mathbf{20}_7$. Further, the connecting portion 37 is formed at one end portion of the metal layer $\mathbf{301}_7$. The metal layer $\mathbf{301}_7$ and the connecting portion 37 are integrally formed. The metal layer $\mathbf{301}_7$ is provided with a slit portion $\mathbf{301}x$. The slit portion $\mathbf{301}x$ is provided to facilitate forming the spiral shape of the coil when shaping (die cutting or the like) the coil substrate 1 in the following step.

Next, the open portion $\mathbf{10}_{72}$ (through hole) is formed that penetrates the substrate $\mathbf{10}_7$, and the insulating layer $\mathbf{20}_7$, the metal layer $\mathbf{301}_7$ and the insulating layer $\mathbf{40}_7$ of the seventh structure 1G. FIG. 15B is a plan view and FIG. 15A is a cross-sectional view of FIG. 15B taken along an A-A line of FIG. 15B. The plan shape and the method of forming the open portion $\mathbf{10}_{72}$ may be the same as those of the open portion $\mathbf{10}_{21}$ or the like, for example. The open portion $\mathbf{10}_{72}$ is formed at a position that overlaps the via wiring $\mathbf{60}_{10}$ in a plan view when the sixth structure 1E and the seventh structure 1G are stacked with each other in the predetermined direction. The insulating layer $\mathbf{40}_7$ is not illustrated in FIG. 15B.

Figure 16A:
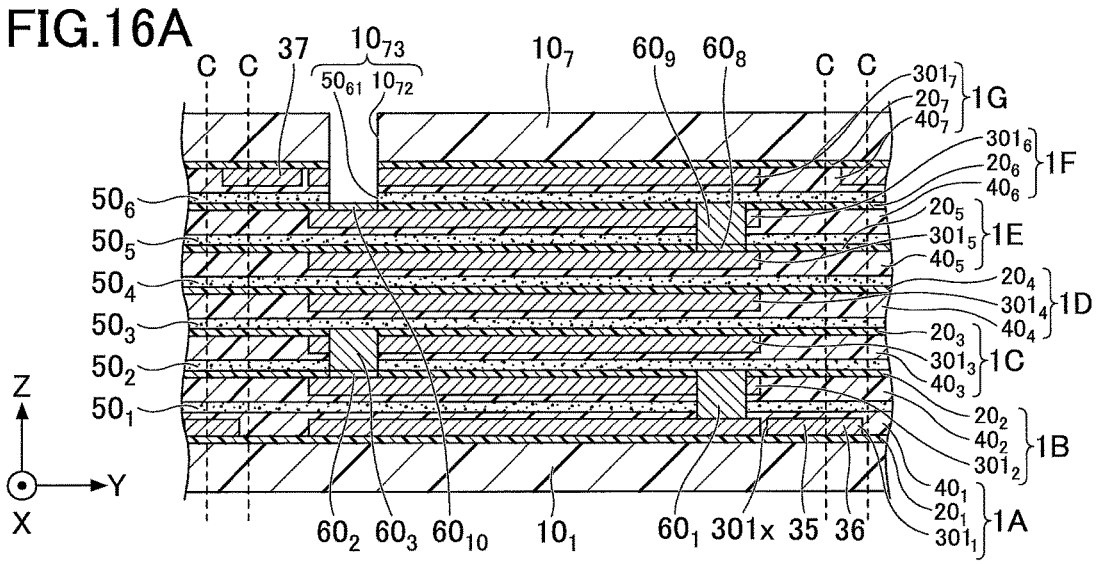
FIG. 16A to FIG. 16C are views illustrating an example of the manufacturing method of the coil substrate of the embodiment.
Figure 16B:
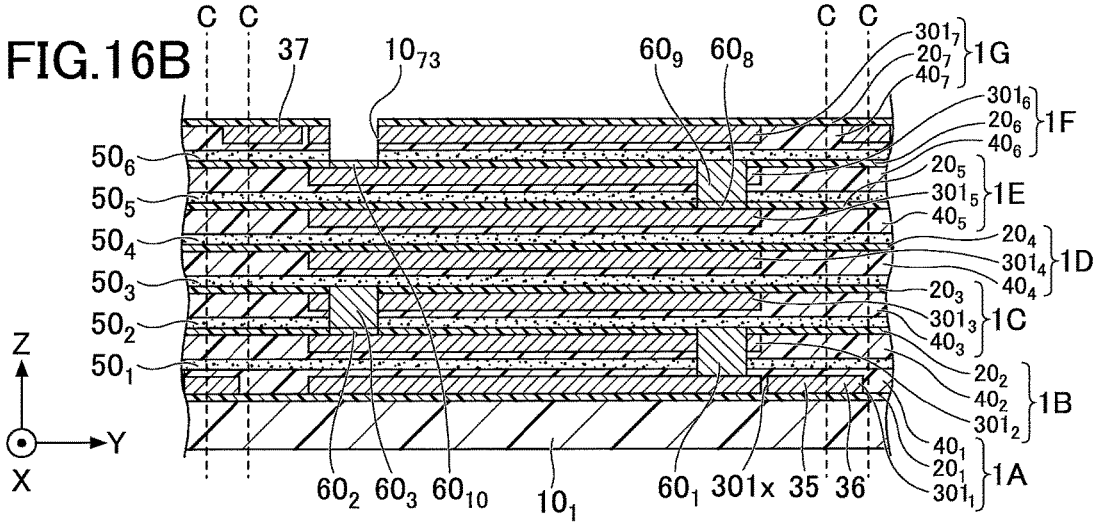
Figure 16C:
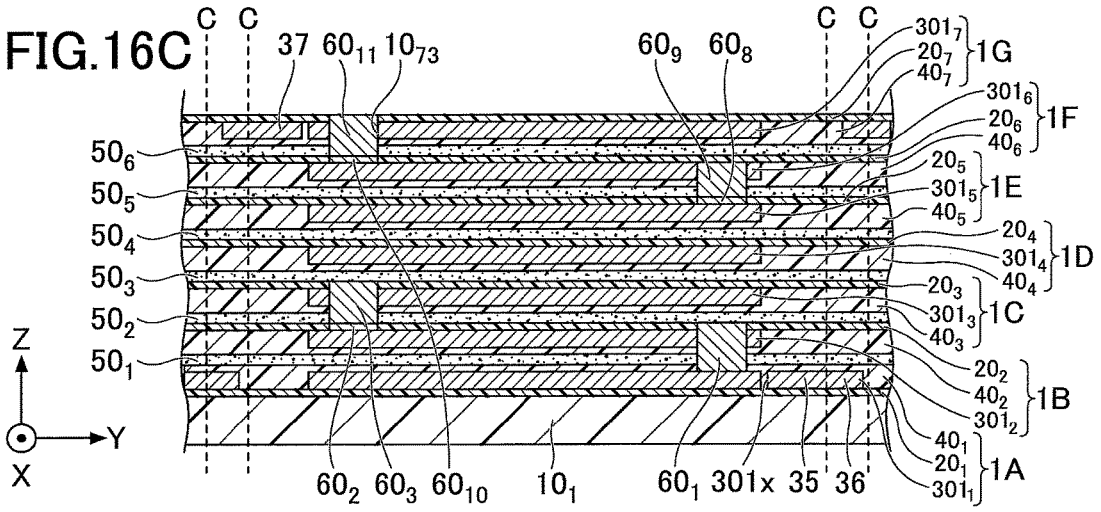

Next, steps illustrated in FIG. 16A to FIG. 16C are explained. FIG. 16A to FIG. 16C are cross-sectional views corresponding to FIG. 14C and FIG. 15A. First, in a step illustrated in FIG. 16A, the adhesion layer $\mathbf{50}_6$ is prepared and the open portion $\mathbf{50}_{61}$ (through hole) that penetrates the adhesion layer $\mathbf{50}_6$ is formed. The open portion $\mathbf{50}_{61}$ is formed at a position that overlaps the via wiring $\mathbf{60}_{10}$ in a plan view when the sixth structure 1F and the seventh structure 1G are stacked with each other through the adhesion layer $\mathbf{50}_6$ in the predetermined direction.

Next, the substrate $\mathbf{10}_7$ and the seventh structure 1G are reversed from the state illustrated in FIG. 15A, and are stacked on the sixth structure 1F through the adhesion layer $\mathbf{50}_6$. This means that the sixth structure 1F and the seventh structure 1G are faced to be staked while interposing the adhesion layer $\mathbf{50}_6$ such that the substrate $\mathbf{10}_1$ and the substrate $\mathbf{10}_7$ are positioned outside. Thereafter, the adhesion layer $\mathbf{50}_6$ is cured. At this time, as the open portion $\mathbf{50}_{61}$ and the open portion $\mathbf{10}_{72}$ are in communication with each other, a single open portion $\mathbf{10}_{73}$ is formed and the upper surface of the via wiring $\mathbf{60}_{10}$ is exposed at a bottom portion.

Alternatively, in the steps illustrated in FIG. 15A to FIG. 16A, the seventh structure 1G may be stacked on the sixth structure 1F through the adhesion layer $\mathbf{50}_6$ before forming the open portions, and thereafter, the open portions $\mathbf{10}_{72}$ and $\mathbf{50}_{61}$ may be formed.

Next, in a step illustrated in FIG. 162, the substrate $\mathbf{10}_7$ is removed (peeled) from the insulating layer $\mathbf{20}_7$ of the seventh structure 1G.

Next, in a step illustrated in FIG. 16C, the via wiring $\mathbf{60}_{11}$ is formed on the via wiring $\mathbf{60}_{10}$ that is exposed at the bottom portion of the open portion $\mathbf{10}_{73}$. The metal layer $\mathbf{301}_6$ and the metal layer $\mathbf{301}_7$ are electrically connected in series through the via wirings $\mathbf{60}_{10}$ and $\mathbf{60}_{11}$.

The via wiring $60_{11}$ may be formed by electroplating in which the bus line 36 is used for supplying power or by filling metal paste, similar to the via wiring $60_1$ or the like. For the material of the via wiring $60_{11}$, copper (Cu) or the like may be used, for example. The upper surface of the via wiring $60_{11}$ may be flush with the upper surface of the insulating layer $20_7$. With this process, in the stacked structure in which the first structure 1A to the seventh structure 1G are stacked, the metal layers $301_1$, $301_2$, $301_3$, $301_4$, $301_5$, $301_6$ and $301_7$ are connected in series through the via wirings. Those connected parts become the coil of about five and ½ rolls after finally shaped (by die cutting or the like).

Figure 17A:
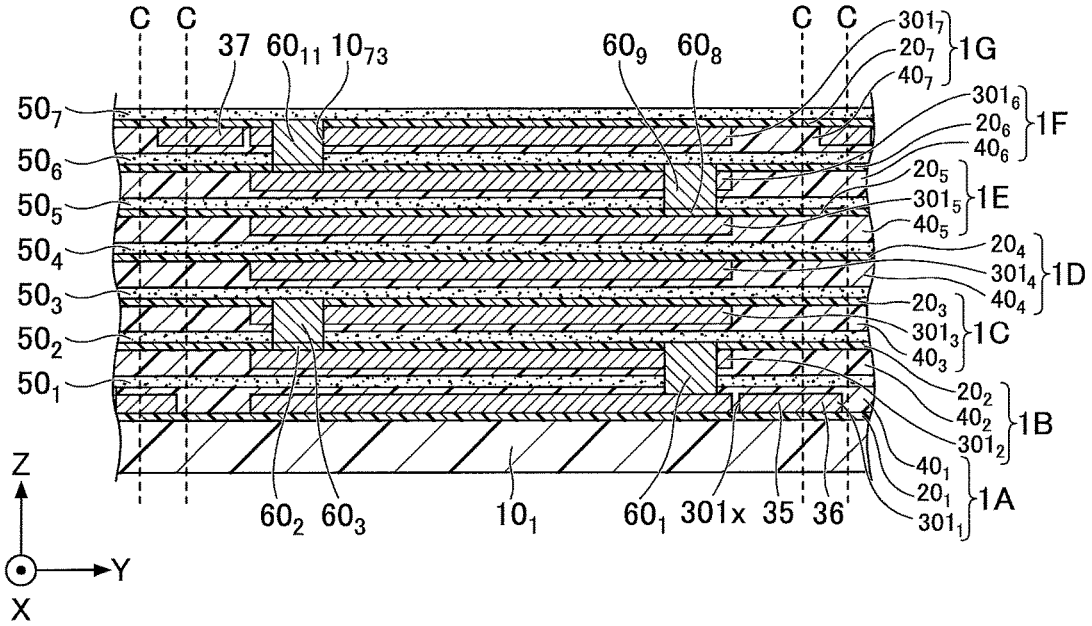
FIG. 17A and FIG. 17B are views illustrating an example of the manufacturing method of the coil substrate of the embodiment.
Figure 17B:
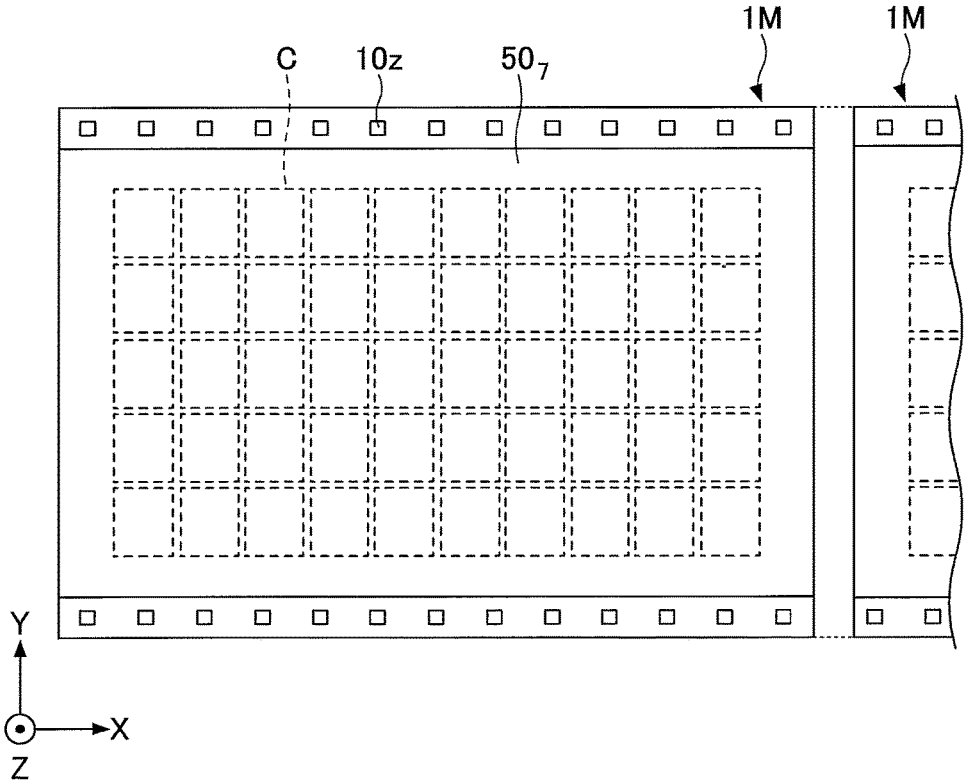

Next, in a step illustrated in FIG. 17A, the adhesion layer $50_7$ is stacked on the seventh structure 1G in which an open portion is not provided. Next, in a step illustrated in FIG. 17B, the structure illustrated in FIG. 17A is individualized by being cut along the cut position D illustrated in FIG. 4A and FIG. 43 to form a substrates 1M. For the example illustrated in FIG. 17A and FIG. 173, each of the substrates 1M includes 50 individual areas C. Alternatively, the step illustrated in FIG. 17B may not be performed and the reel (tape) structure for which the steps illustrated in FIG. 21A to FIG. 21C are performed may be shipped as a product.

Figure 18:
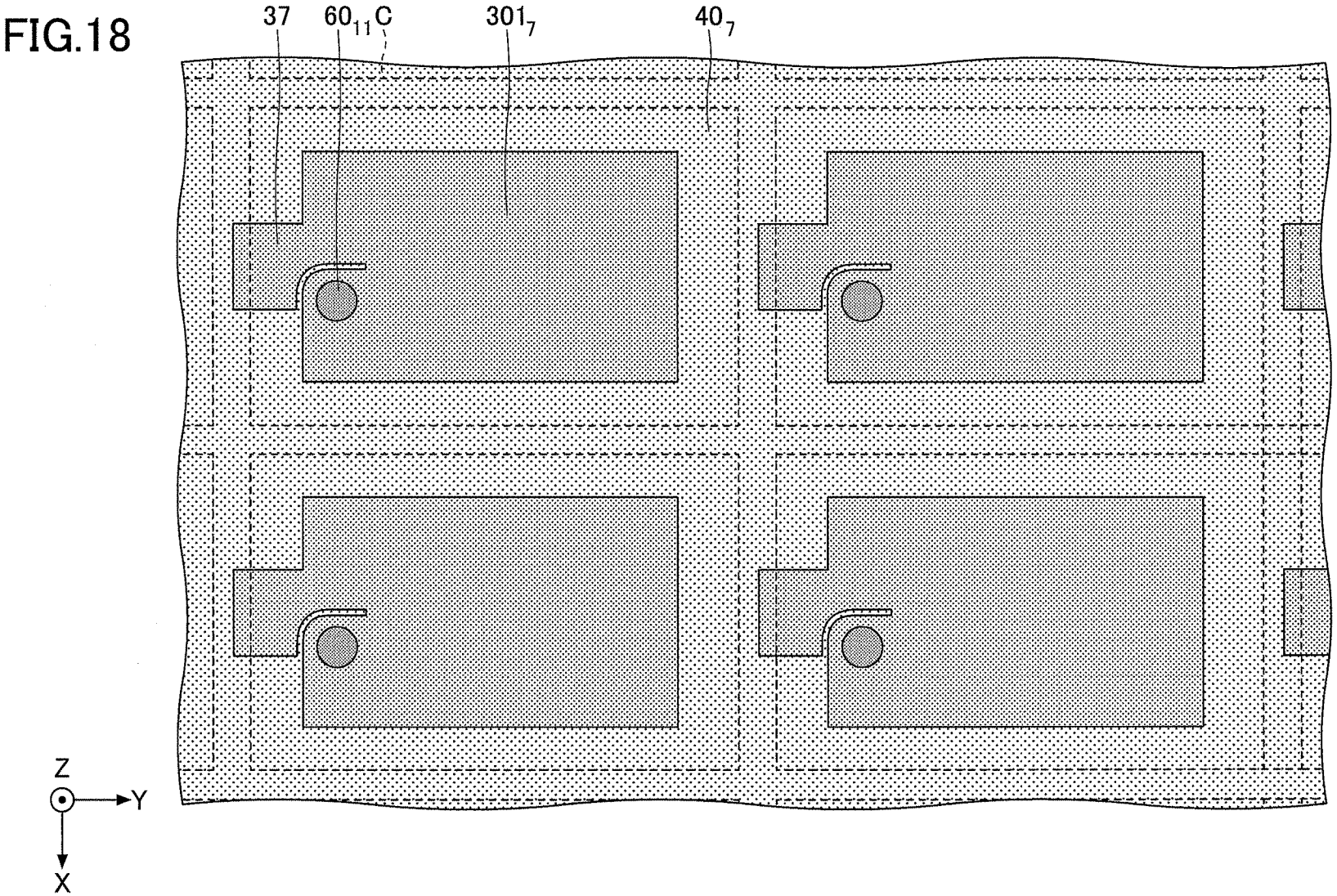
FIG. 18 is a view illustrating an example of the manufacturing method of the coil substrate of the embodiment.
Figure 19:
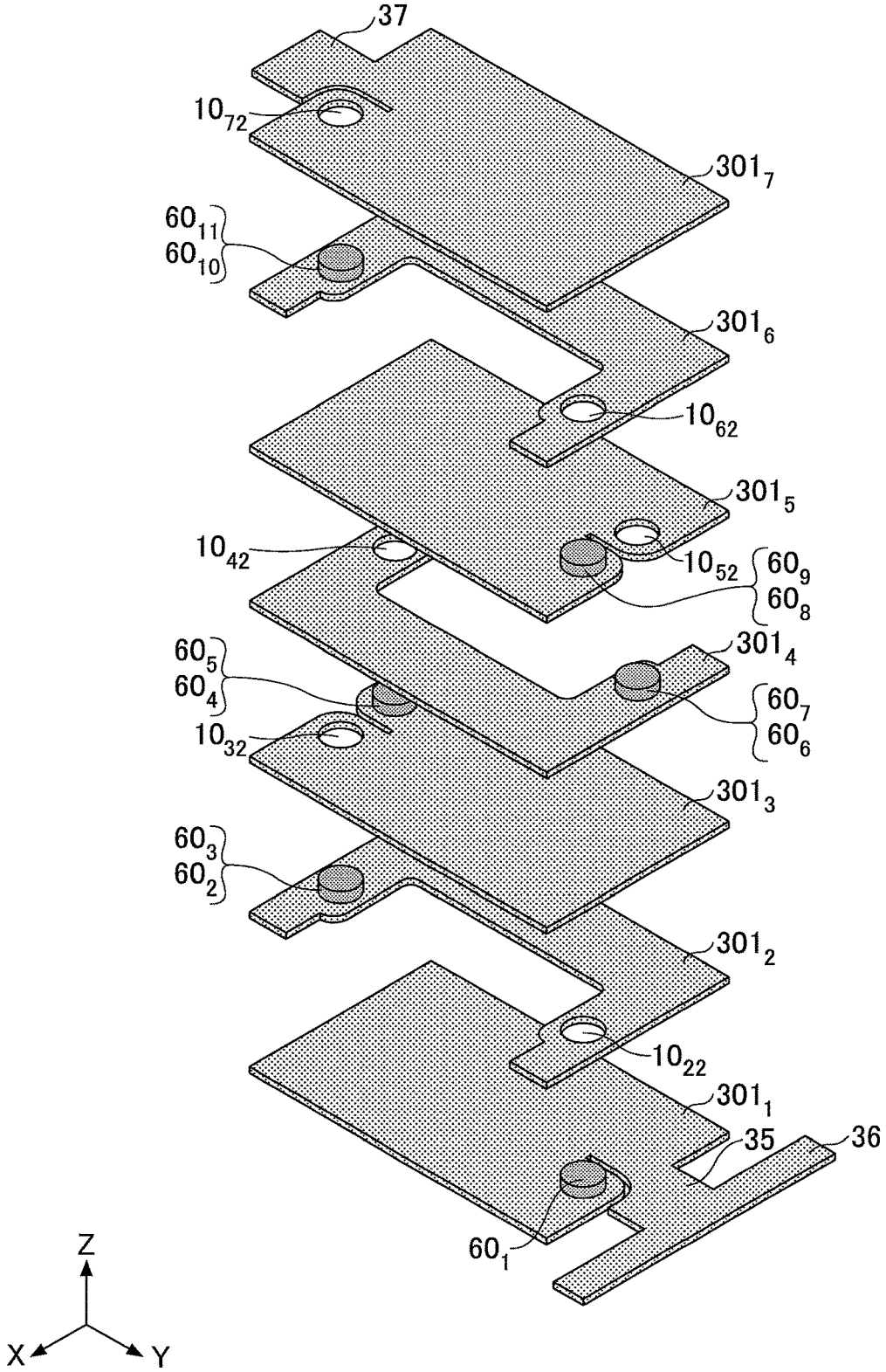
FIG. 19 is a view illustrating an example of the manufacturing method of the coil substrate of the embodiment.
Figure 20:
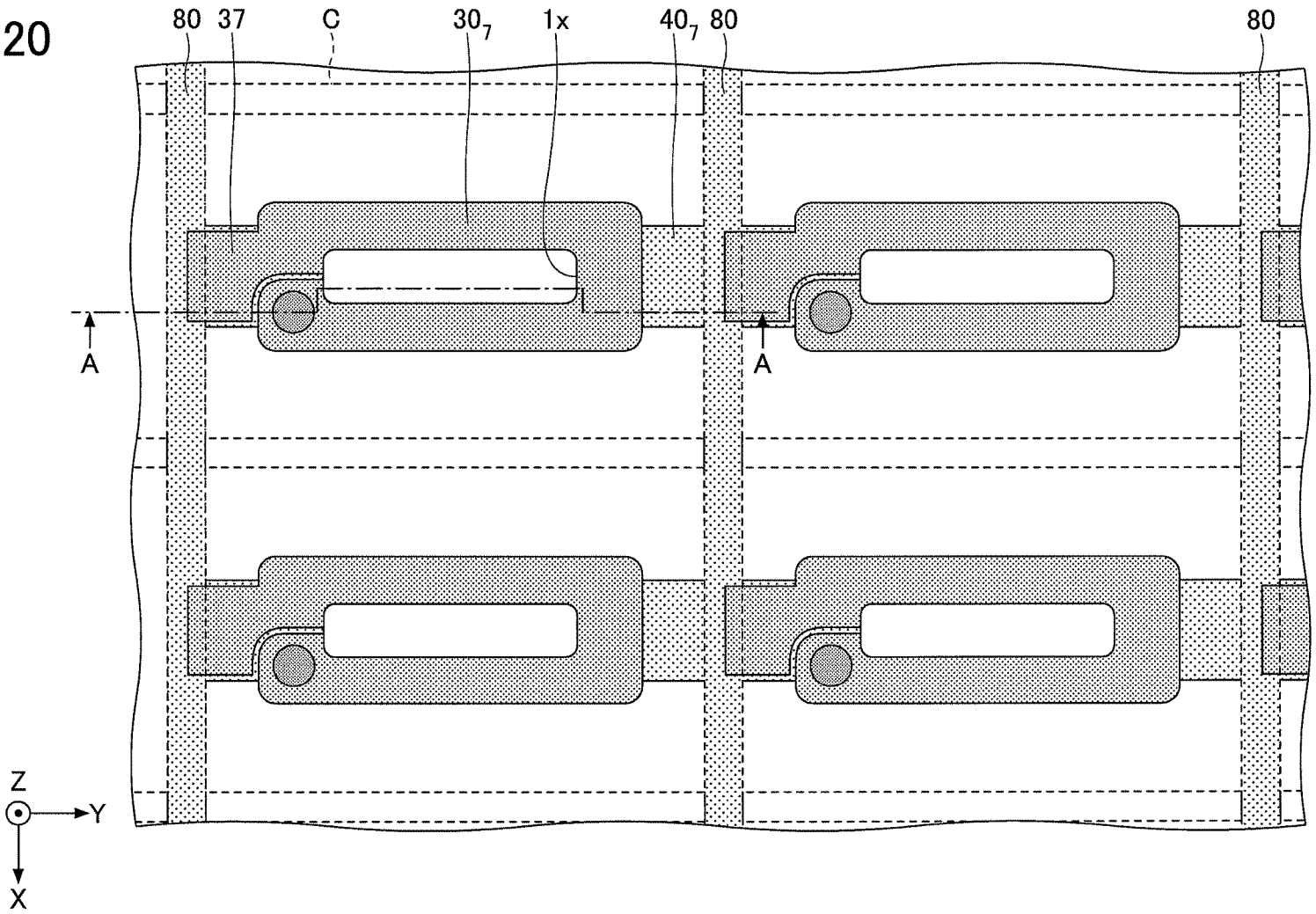
FIG. 20 is a view illustrating an example of the manufacturing method of the coil substrate of the embodiment.
Figure 21A:
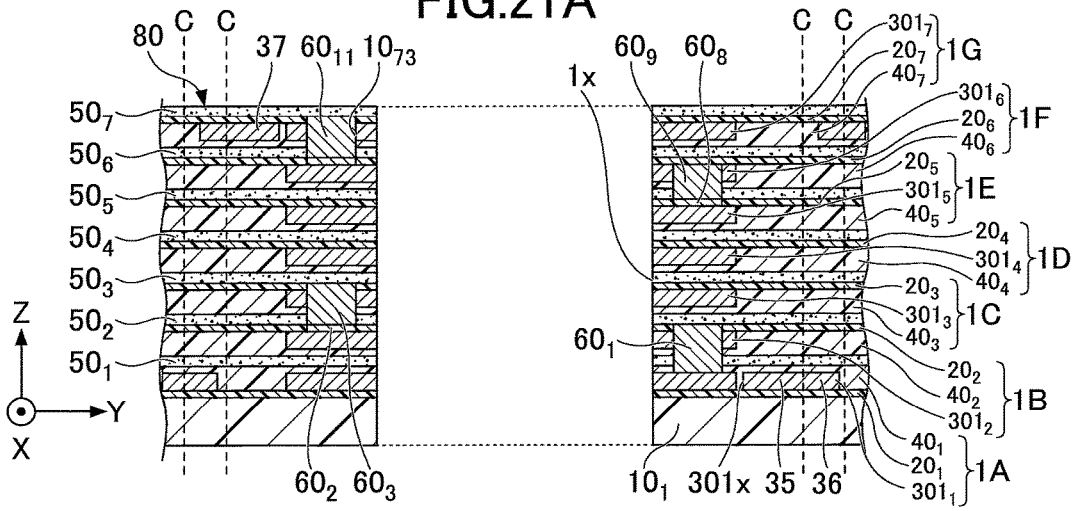
FIG. 21A to FIG. 21C are views illustrating an example of the manufacturing method of the coil substrate of the embodiment.
Figure 21B:
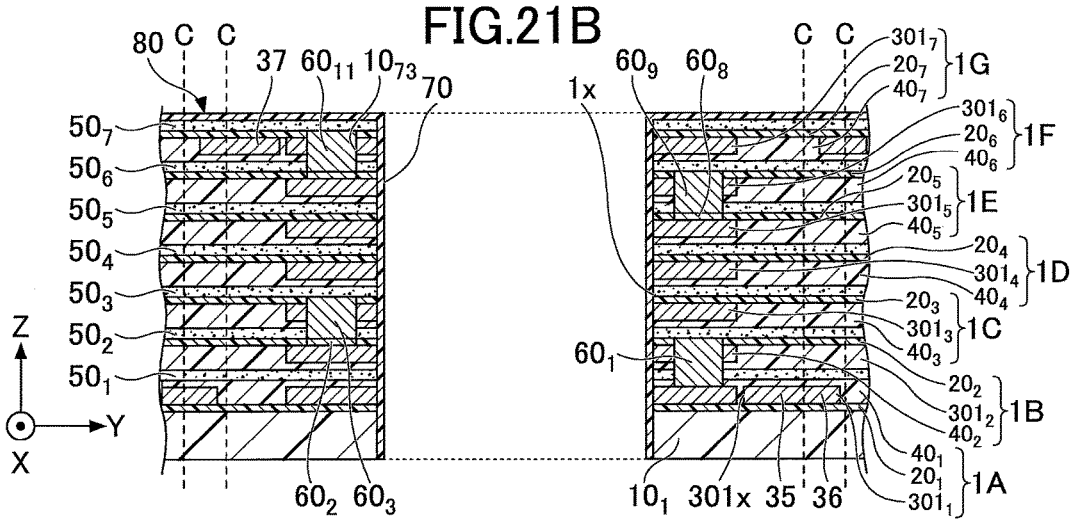
Figure 21C:
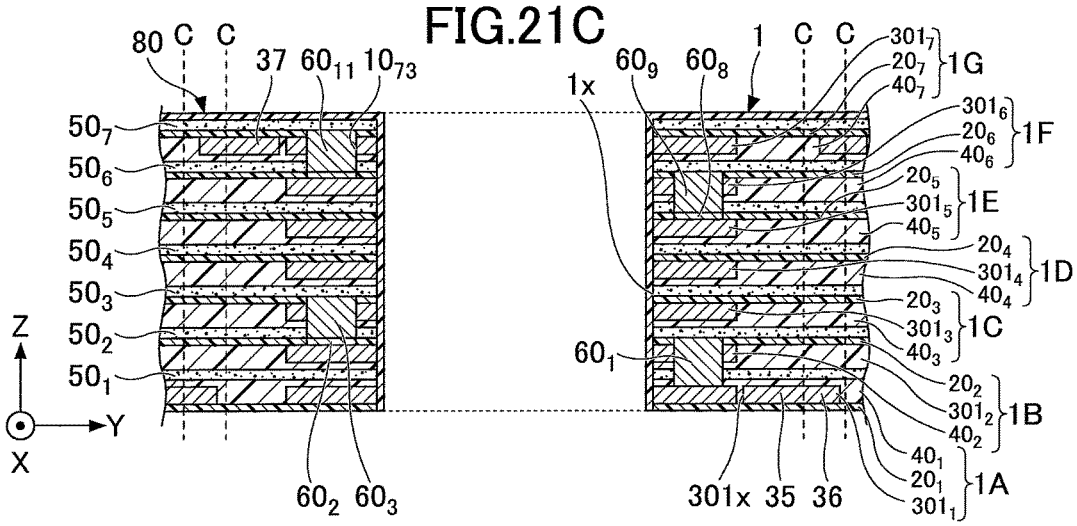

Next, in steps illustrated in FIG. 18 to FIG. 21A, the substrate 1M is shaped (by die cutting or the like) to form the metal layer formed in each of the layers into the wiring that constitutes a part of the spiral-shaped coil by removing unnecessary parts. FIG. 18 is a plan view illustrating an example of the metal layer $301_7$ before die cutting or the like the substrate 1M (layers position upper than the metal layer $301_7$ are not illustrated). FIG. 19 is a perspective view schematically illustrating each metal layer formed in each of the layers before die cutting or the like the substrate 1M. The substrate 1M in which the metal layers as illustrated in FIG. 18 and FIG. 19 are shaped by press working using a die or the like to be in a form illustrated in FIG. 20 and FIG. 21A. FIG. 20 is a plan view corresponding to FIG. 18 and FIG. 21A is a cross-sectional view of FIG. 20 taken along an A-A line in FIG. 20. The shape of the wiring of each of the layers of the structure illustrated in FIG. 20 and FIG. 21A becomes such as illustrated in FIG. 2. The substrate 1M may be formed by laser processing or the like instead of press working using a die or the like.

With this process, in the stacked structure in which the first structure 1A to the seventh structure 1G are stacked, the metal layer $301_1$ is shaped to become the first wiring $30_1$. Similarly, the metal layers $301_2$, $301_3$, $301_4$, $301_5$, $301_6$ and $301_7$ are shaped to become the second wiring $30_2$, the third wiring $30_3$, the fourth wiring $30_4$, the fifth wiring $30_5$, sixth wiring $30_6$ and the seventh wiring $30_7$, respectively. The first wiring $30_1$, the second wiring $30_2$, the third wiring $30_3$, the fourth wiring $30_4$, the fifth wiring $30_5$, the sixth wiring $30_6$ and the seventh wiring $30_7$ are electrically connected in series through the via wirings to constitute the spiral-shaped coil of about 5 and ½ rolls.

The stacked structured in each of which the first structure 1A to the seventh structure 1G are stacked are formed in the individual areas C, respectively, and are connected (not electrically connected) through linking portions 80 including the insulating layer $40_7$ or the like formed between the adjacent individual areas C. The insulating layer $40_7$ or the like that constitutes the stacked structure of each of the individual areas C also has the substantially the same shape as the wiring and the through hole 1*x* that penetrates the layers is formed at a substantially center portion of each of the stacked structures.

Next, in steps illustrated in FIG. 215, the insulating film 70 is formed so as to cover the surfaces of the stacked structure in which the first structure 1A to the seventh structure 1G are stacked except the bottom surface. This means that the insulating film 70 is formed that continuously covers the outer wall surface (sidewall) of the stacked structure formed at each of the individual areas C, the upper surface of the adhesion layer $50_7$ and the inner wall surface of the through hole 1*x* (see FIG. 1C far plan shape). As the end surfaces of the wirings are exposed at the outer wall surface (sidewall) of the stacked structure or at the inner wall surface of the through hole 1*x*, there is a possibility that short between the wirings and the conductive material (magnetic filler or the like) that may be included in the sealing resin 110 may occur when the inductor 100 (see FIG. 3) is manufactured. Thus, by forming the insulating film 70 at surfaces of the stacked structure, the short between the wirings and the conductive material (magnetic filler or the like) that may be included in the sealing resin 110 is prevented.

For the insulating film 70, epoxy based insulating resin, acrylic based insulating resin or the like may be used, for example. The insulating film 70 may include filler such as silica or the like, for example. The insulating film 70 may be formed by spin coating, spray coating or the like, for example. Electrodepositing resist may be used as the insulating film 70. In this case, the electrodepositing resist is deposited only on the end surfaces of the wirings that are exposed at the outer wall surface (sidewall) of the stacked structure or the inner wall surface of the through hole 1*x* by electrodeposition coating. The thickness of the insulating film 70 may be about 20 to 50 μm, for example.

Next, in a step illustrated in FIG. 21C, the substrate $10_1$ is removed from the insulating layer $20_1$. With this, the coil substrate 1 (see FIG. 1A to FIG. 1C) is formed in each of the individual areas C. The coil substrates 1 at the adjacent individual areas C are connected (not electrically connected) with each other through the linking portion 80 that is formed between those adjacent individual areas C.

Figure 22A:
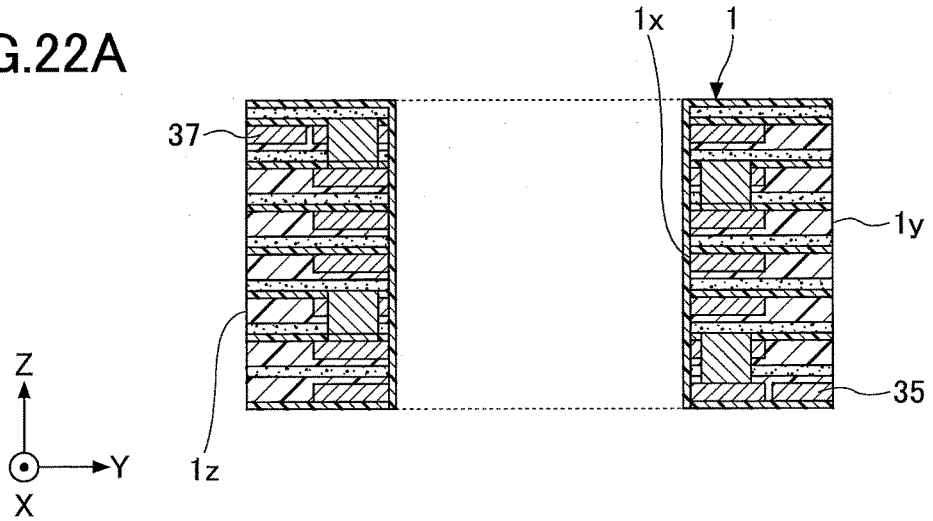
FIG. 22A to FIG. 22C are view illustrating an example of a manufacturing method of an inductor of the embodiment.

In order to manufacture the inductor 100 (see FIG. 3), as illustrated in FIG. 22A, the coil substrates 1 illustrated in FIG. 21C are cut for each of the individual areas C, for example. With this, the linking portions 80 are removed and the individualized plurality of coil substrates 1 are formed. At this time, the side surface of the connecting portion 35 is exposed at the one side surface 1*y* and the side surface of the connecting portion 37 is exposed at the other side surface 1*z*, of each of the coil substrates 1.

Figure 22B:
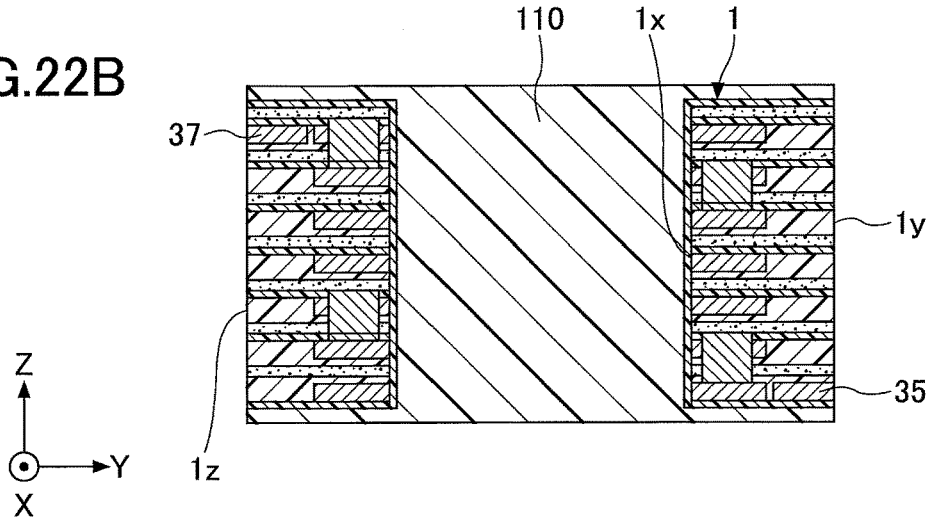

Next, as illustrated in FIG. 22B, the sealing resin 110 is formed to seal the coil substrate 1 except the one side surface 1*y* and the side surface 1*z* by transfer mold or the like, for example. For the sealing resin 110, insulating resin such as epoxy based insulating resin or the like including magnetic filler such as ferrite or the like may be used, for example. Alternatively, the sealing resin 110 may be formed for the entirety of the individual areas C where the coil substrates 1 which are connected with each other through the linking portions 80 are formed as illustrated in FIG. 21C, and then, the coil substrates 1 may be cut to with the sealing resin 110 for each of the individual areas C to form the structure illustrated in FIG. 22B.

Figure 22C:
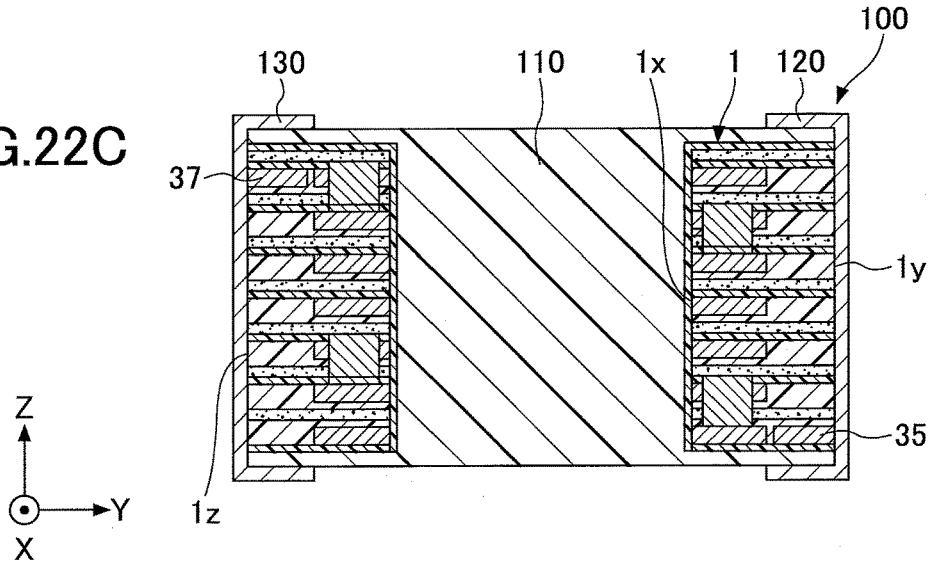

Next, as illustrated in FIG. 22C, the electrode 120 composed of copper (Cu) or the like that continuously covers the one side surface and parts of the upper surface and the lower surface of the sealing resin 110 is formed by plating or paste coating. The inner wall surface of the electrode 120 contacts the side surface of the connecting portion 35 that is exposed from the one side surface 1*y* of the coil substrate 1 so that the electrode 120 and the connecting portion 35 are electrically connected. Similarly, the electrode 130 composed of copper (Cu) or the like that continuously covers the other side surface and parts of the upper surface and the lower surface of the sealing resin 110 is formed by plating or paste coating. The inner wall surface of the electrode 130 contacts the side surface of the connecting portion 37 that is exposed from the other side surface 1*z* of the coil substrate 1 so that the electrode 130 and the connecting portion 37 are electrically connected. With this, the inductor 100 is completed.

As such, according to the coil substrate 1 of the embodiment, a single spiral-shaped coil is formed by manufacturing a plurality of structures in each of which a wiring that becomes a part of the spiral-shaped coil is covered by an insulating film, and stacking the structures through adhesion layers, respectively, such that the wirings of the structures are connected in series through via wirings, respectively. With this, by increasing the stacking number of the structures, a coil with the desired number of rolls can be obtained without changing the plan shape. This means that the number of rolls (the number of turns) of the coil can be increased with a size smaller (the plan shape of about 1.6 mm×0.8 mm, for example) than conventional coils.

Further, for example, a method may be considered in which a wiring that constitutes a part of a coil is previously patterned in each structure, and then the structures are stacked. However, in such a method, there may be shifts between the wirings of the structures in a leftward/rightward direction so that the wirings may not be stacked to completely overlap with each other in a plan view. Then, when a through hole or the like is formed in the stacked structure, a part of the wirings, which may be shifted with each other, may be removed. This kind of problem may be resolved by making the width of each of the wirings, which is previously formed in the respective structure, smaller in order to ensure areas where the wirings are not formed. However, in such a case, direct current resistance of the coil may be increased.

On the other hand, according to the method of manufacturing the coil substrate of the embodiment, a metal layer having a plan shape larger than that of a wiring of a final product is formed in each structure, a stacked structure is formed by stacking the structures, and the stacked structure is shaped in the thickness direction such as to form the metal layers into the shape of wirings each having a shape to constitute the spiral-shaped coil at the same time. Thus, the wirings are not shifted in the leftward/rightward direction, and the spiral-shaped coil can be obtained by the wirings that are stacked to high accurately overlap with each other in a plan view. As a result, direct current resistance can be decreased. This means that each of the wirings can be made wider so that the direct current resistance can be decreased as there is no need to worry about the shifts of the wirings in the leftward/rightward direction.

Further, as the number of rolls of the coil can be increased by increasing the stacking number of the structures without changing the plan shape, a small-size coil substrate with larger inductance can be easily obtained.

Further, a width of a wiring that is formed in each structure (one layer) can be made wider because the number of rolls of the wiring that is formed in each of the structures (one layer) is less than or equal to one of the coil. Thus, it is possible to increase the cross section of the wiring in the width direction, and winding resistance that influences performance of the inductor can be decreased.

Further, although the flexible insulating resin film (polyphenylenesulfide film or the like, for example) is used as the substrate 10*n* when manufacturing the coil substrate 1, the substrate 10*n* is removed and does not remain in a final product. Thus, the coil substrate 1 can be made thinner.

Further, by using a reel (tape) flexible insulating resin film (polyphenylenesulfide film or the like, for example) as the substrate 10*n*, the coil substrate 1 can be formed on the substrate 10*n* in a reel to reel process. With this, the cost for manufacturing the coil substrate 1 can be reduced due to mass production.

According to the embodiment, a smaller coil substrate or the like can be provided.

Although a preferred embodiment of the coil substrate, the method of manufacturing the coil substrate and the inductor has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

For example, a combination of the number of rolls that each wiring (one layer) of each of a plurality of structures has, may be arbitrarily determined. For example, a combination of the wirings of about one roll and the wirings of about ¾ roll may be used as the above explained embodiment, or alternatively, a combination of wirings of about one roll and wirings of about ½ roll may be used. When the wirings of about ¾ roll are used, 4 kinds of pattern of wirings (the second wiring $\mathbf{30}_2$, the third wiring $\mathbf{30}_3$, the fourth wiring $\mathbf{30}_4$ and the fifth wiring $\mathbf{30}_5$, for example) are necessary. However, when the wirings of about ½ roll are used, only two kinds of pattern of wirings are necessary.

Further, in the above embodiment, "electrically connected in series" means that each of the wirings is connected to a first wiring that is included in an adjacent lower structure, for example, at one end, and is connected to a second wiring that is included in an adjacent upper structure, for example, at another end. Specifically, with reference to FIG. 2, one end (where the open portion $\mathbf{10}_{22}$ is formed) of the second wiring $\mathbf{30}_2$ is connected to the first wiring $\mathbf{30}_1$ while another end (where the via wirings $\mathbf{60}_2$ and $\mathbf{60}_3$ are formed) of the second wiring $\mathbf{30}_2$ is connected to the third wiring $\mathbf{30}_3$.

What is claimed is:

1. A coil substrate comprising:

a stacked structure in which a plurality of structures are stacked, each of the structures including a first insulating layer and a wiring formed on the first insulating layer, which becomes a part of a spiral-shaped coil; and an insulating film that covers a surface of the stacked structure, the spiral-shaped coil being formed by connecting the wirings of the adjacent structures in series, wherein the stacked structure is provided with a through hole that penetrates the stacked structure such that a part of an end surface of the wiring and a part of an end surface of the first insulating layer of each of the structures is exposed at an inner wall surface of the through hole, wherein the end surface of the wiring and the end surface of the first insulating layer are flush with each other at the inner wall surface of the through hole, and wherein the end surface of the wiring and the end surface of the first insulating layer of each of the structures exposed at the inner wall surface are covered by the insulating film.

2. The coil substrate according to claim 1, wherein each of the structures further includes a second insulating layer formed on the first insulating layer such as to cover the wiring, wherein a part of an end surface of the second insulating layer of each of the structures is exposed at the inner wall surface of the through hole, wherein the end surface of the second insulating layer is flush with the end surface of the wiring and the end surface of the first insulating layer at the inner wall surface of the through hole, and wherein the end surface of the second insulating layer of each of the structures exposed at the inner wall surface is also covered by the insulating film.

3. The coil substrate according to claim 1, wherein a part of an end surface of the wiring of each of the structures is exposed at an outer wall surface of the stacked structure, and wherein the end surface of the wiring of each of the structures exposed at the outer wall surface is covered by the insulating film.

4. The coil substrate according to claim 1, wherein the wiring of each of the structures is less than or equal to one turn of the spiral-shaped coil.

5. The coil substrate according to claim 1, wherein in at least one of the structures, a connecting portion is provided at an end portion of the respective wiring that is integrally formed with the wiring, and wherein a part of the connecting portion is exposed from the insulating film.

6. The coil substrate according to claim 1, further comprising a plurality of a combination of the stacked structure and the insulating film, the combinations being aligned while being connected with each other through a linking portion.

7. The coil substrate according to claim 1, wherein the first insulating layer is made of insulating resin.

8. The coil substrate according to claim 1, wherein the insulating film is made of insulating resin.

9. The coil substrate according to claim 2, wherein the second insulating layer is made of insulating resin.

10. An inductor comprising:

the coil substrate according to claim 5;

a resin including a magnetic material that covers the coil substrate while exposing the part of the connecting portion; and an electrode formed on the resin and electrically connected to the part of the connecting portion.

11. The inductor according to claim 10, wherein the resin is filled in the through hole that penetrates the coil substrate.

12. The inductor according to claim 10, wherein the magnetic material is magnetic filler.

13. An inductor comprising:

the coil substrate according to claim 5 provided with the through hole that penetrates the coil substrate; and a magnetic material filled in the through hole.

* * * * *